US010063035B2

(12) United States Patent
Kanehara et al.

(10) Patent No.: US 10,063,035 B2
(45) Date of Patent: Aug. 28, 2018

(54) IGNITION DEVICE AND METHOD OF PRODUCING SUPER HYDROPHILIC MEMBRANE TO BE USED IN IGNITION DEVICE

(71) Applicant: DENSO CORPORATION, Kariya, Aichi-pref. (JP)

(72) Inventors: Kenji Kanehara, Kariya (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/533,524

(22) PCT Filed: Dec. 8, 2015

(86) PCT No.: PCT/JP2015/084367
§ 371 (c)(1),
(2) Date: Jun. 6, 2017

(87) PCT Pub. No.: WO2016/093214
PCT Pub. Date: Jun. 16, 2016

(65) Prior Publication Data

US 2017/0373474 A1 Dec. 28, 2017

(30) Foreign Application Priority Data

Dec. 8, 2014 (JP) ..... 2014-247763
Nov. 27, 2015 (JP) ..... 2015-232194

(51) Int. Cl.
*F02P 23/04* (2006.01)
*H01T 13/14* (2006.01)

(52) U.S. Cl.
CPC ..... *H01T 13/14* (2013.01); *F02P 23/04* (2013.01)

(58) Field of Classification Search
CPC ..... H01T 13/14; H01T 21/04; F02B 51/02; F02B 77/005; F02B 77/04; F02M 27/02
(Continued)

(56) References Cited

U.S. PATENT DOCUMENTS 6,165,256 A 12/2000 Hayakawa et al.
2012/0169205 A1 7/2012 Unger et al.
(Continued)

FOREIGN PATENT DOCUMENTS

JP 2000-291390 10/2000
JP 2011-138771 7/2011

OTHER PUBLICATIONS

Mizuguchi, Complete Decomposition and Recycling Technique for FRP by Thermal Activation of Semiconductor, Textile Processing Technology, vol. 47, No. 7, 2012 (14 pages) with partial English Translation (2 pages).

*Primary Examiner* — Hai Huynh
(74) *Attorney, Agent, or Firm* — Nixon & Vanderhye P.C.

(57) ABSTRACT

In an ignition device having an ignition plug for igniting a fuel mixture gas introduced in a combustion chamber, a super hydrophilic membrane is formed on a surface at the combustion chamber side of a plug forming member of the ignition plug. The super hydrophilic membrane contains super hydrophilic particles and thermal excitation catalyst particles, and satisfies a relationship of $\theta_{W2}<\theta_{W1}$, where $\theta_{W1}$ indicates a water contact angle between water and the plug forming member on which no super hydrophilic membrane is formed, and $\theta_{W2}$ indicates a water contact angle between water and the plug forming member on which the super hydrophilic membrane is formed.

17 Claims, 11 Drawing Sheets

(58) Field of Classification Search
USPC ..... 123/270, 271, 272, 297, 668, 669, 670, 123/143 B
See application file for complete search history.

(56) References Cited

U.S. PATENT DOCUMENTS

| | | | |
|---|---|---|---|
| 2012/0262049 | A1 | 10/2012 | Kurono et al. |
| 2013/0133602 | A1 | 5/2013 | Woerner et al. |
| 2014/0131927 | A1 | 5/2014 | Unger et al. |

IGNITION DEVICE AND METHOD OF PRODUCING SUPER HYDROPHILIC MEMBRANE TO BE USED IN IGNITION DEVICE

This application is the U.S. national phase of International Application No. PCT/JP2015/084367 filed 8 Dec. 2015, which designated the U.S. and claims priority to JP Patent Application No. 2014-247763 filed 8 Dec. 2014, and JP Patent Application No. 2015-232194 filed 27 Nov. 2015, the entire contents of each of which are hereby incorporated by reference.

TECHNICAL FIELD

The present invention relates to ignition devices for igniting a fuel mixture gas introduced into a combustion chamber of an internal combustion engine, and in particular, relates to ignition devices having an ignition plug, on a surface of which a super hydrophilic membrane is formed and coated. The formation of the super hydrophilic membrane prevents a deposit from adhering on the surface of the ignition plug, and provides the ignition plug having a stable ignitability. The present invention further relates to a method of producing such super hydrophilic membranes to be used in the ignition devices

BACKGROUND ART

Recently, there have been various studies and development regarding laser ignition devices to be applied to gaseous fuel engines to be used for cogeneration, and to be applied to internal combustion engines of poor ignition performance such as lead burn fuel mixture engines, etc. The laser ignition device has a semiconductor laser as an excitation light source, and oscillates excitation light and irradiates the excitation light to a laser resonator. The laser resonator oscillates a pulse laser having a high energy density on the basis of the received excitation light. A condenser unit in the laser resonator condenses the pulse laser in a fuel gas mixture introduced in the combustion chamber of the internal combustion engine so as to ignite the fuel gas mixture.

Such a laser ignition device has an ignition plug. The ignition plug has an optical element, an optical window, etc. The optical widow has heat-resistant and is arranged at a boundary between a combustion chamber and the ignition plug so as to prevent the optical element in the ignition plug from a high temperature and pressure gas in the combustion chamber. The optical element focuses the pulse laser in the inside of the combustion chamber of the internal combustion chamber so as to ignite a fuel gas mixture in the combustion chamber.

On the other hand, because the internal combustion engine uses an engine oil to reduce abrasion, etc. generated between a piston and a cylinder of the internal combustion engine, an oil mist occurs in the combustion chamber. Such oil mist floats in the inside of the combustion chamber, and is adhered on the surface at the combustion chamber side of the optical window. When a deposit is accumulated on the surface of the optical window due to the oil mist, the optical transmission properties of the pulse laser are reduced due to the deposition of such oil mist, and the presence of the deposit reduces the stable ignition capability of the ignition plug. It is accordingly desired to prevent such oil mist from being adhered on the surface at the combustion chamber side of the optical window of the ignition plug.

Further, for example, when an engine starts and an ordinary spark ignition plug operates at a low temperature and a liquid fuel is burned in incomplete combustion, soot, etc. are generated due to the incomplete combustion, and a deposit is accumulated due to such soot on a surface of an insulation glass in the ordinary ignition plug. Because the deposit is made of carbon having a conductivity, the formation of deposit reduces the electrical insulation between electrodes of the ignition plug, and deteriorates the stable ignitability of the ignition plug.

The patent document 1 has disclosed a laser-guided type external ignition plug so as to solve the conventional problem previously described. In the ignition device according to the patent document 1, a sub-chamber is formed in a combustion chamber at an end side of a combustion chamber window, and an aperture diaphragm is formed in the sub-chamber through which the laser beam passes and enters the inside of the combustion chamber through the sub-chamber. A laser beam enters the combustion chamber through the aperture diaphragm. The patent document 2 disclose an ignition plug in which an outer surface of an insulator is coated by a silicon resin.

CITATION LIST

Patent Literature

[Patent Document 1]
Japanese patent laid open publication No. JP 2013-527376; and
[Patent document 2] Japanese unexamined patent application publication (Translation of PCT Application) No. JP 2013-545258.

SUMMARY OF INVENTION

Technical Problem

The conventional countermeasure of the patent document 1 previously described can prevent oil mist from being directly adhered on a surface of the optical window because the gas flow to the optical window is limited by the aperture diaphragm.

However, the conventional countermeasure of the patent document 1 previously described cannot prevent the oil mist from being adhered on an inner peripheral surface of the aperture diaphragm. For this reason, the oil mist adhered and accumulated on the inner peripheral wall of the aperture diaphragm is exposed to the gas at a high temperature in the combustion chamber, and the deposit which contains incomplete combustion components such as metal oxide materials is generated during long use of the ignition plug.

In particular, the formation and accumulation of such deposit around the front end of the aperture diaphragm often causes a diffraction of the laser beam, and deteriorates transmission of the laser beam. As a result, there is a possible conventional problem that it is difficult to provide the ignition plug having stable ignition capability.

Further, the conventional countermeasure previously described limits the gas flow at the inside of the aperture diaphragm by the arrangement of the aperture diaphragm at the combustion chamber side of the optical window, but it is difficult to completely prevent the adhesion of oil mist to the optical window. When the oil mist passes through the aperture diaphragm, and reaches the surface of the optical window, it is difficult for the gas flow in the combustion chamber to dislodge and eliminate oil mist adhered on the surface of the optical window from the surface of the optical window. Further, there is a possible case in which the oil mist is further accumulated many time, and the presence of the aperture diaphragm would cause opposite effects.

Furthermore, it is extremely difficult for the ignition plug using the coated silicon resin disclosed by the patent document 2 to completely prevent deposit from being adhered to the insulator in the ignition plug.

The present invention has been made in consideration of the foregoing circumstances, and it is an object of the present invention to provide a laser ignition device, a spark ignition device, and a method of producing a super hydrophilic membrane to be used in the laser ignition device. The laser ignition device according to the present invention promotes decomposition and dislodge oil mist and deposit which have been adhered in a surface of an ignition plug, prevents deposit from being accumulated on the surface of the ignition plug.

Solution to Problem

The ignition device (1, 6) according to the present invention has an ignition plug (4, 60) mounted to a combustion chamber (51) of an internal combustion engine (5). The ignition device ignites a fuel gas mixture introduced into an inside of the combustion chamber. The ignition plug has a plug forming member (10, 7). A super hydrophilic membrane (11) is formed on a surface at the combustion chamber side of the plug forming member. The super hydrophilic membrane contains super hydrophilic particles (110) and thermal excitation catalyst particles (111). The super hydrophilic membrane satisfies a relationship of $\theta_{W2}<\theta_{W1}$, where $\theta_{W1}$ indicates a water contact angle between the plug forming member and water when no super hydrophilic membrane is formed on the surface of the plug forming member, and $\theta_{W2}$ indicates a water contact angle between the plug forming member and water when the super hydrophilic membrane is formed on the surface of the plug forming member. The ignition device is a laser ignition device (1) which condenses a pulse laser ($LSR_{PLS}$) to a focus point in the combustion chamber through an optical window (10) as a plug forming member so as to ignite a mixture gas introduced in the combustion chamber. The pulse laser ($LSR_{PLS}$) has a high density. The optical window (10) as the plug forming member is formed and arranged at a boundary between the ignition plug (4) and the combustion chamber (51) of the internal combustion engine (5). The super hydrophilic membrane is formed at the combustion chamber side on the surface of the optical window as the plug forming member.

The ignition plug (60) of the ignition device has a central electrode (61), a ground electrode (62) and an insulator (7). The central electrode (61) and the ground electrode (62) are arranged at a location which projects to the inside of the combustion chamber of the internal combustion engine. The insulator is a plug forming member which supports an outer periphery of the central electrode (61). The ignition device is a spark ignition device (6) which generates a spark discharge at a gap (G) between the central electrode (61) and the ground electrode (62) so as to ignite the fuel gas mixture which has been introduced in the inside of the combustion chamber. The super hydrophilic membrane is formed on the surface of the insulator (7) as a plug forming member, which faces the combustion chamber. The reference numbers in brackets previously described are added for convenience, and those reference numbers do not limit the scope of the subject matter according to the present invention.

Advantageous Effects of Invention

According to the ignition device, i.e. the laser ignition device and spark ignition device having the structure previously described, because moisture contained in exhaust gas generated by the combustion in the combustion chamber wets and expands on the surface of the super hydrophilic membrane, even if oil mist and carbon are adhered on the plug forming members such as the optical window and insulator of the ignition plug, the oil mist and carbon are easily removed from the plug forming members by the formation of the super hydrophilic membrane. Further, because thermal excitation catalyst particles contained in the super hydrophilic membrane are excited by thermal energy by the combustion of fuel gas in the internal combustion engine, this makes it possible to promote oxidative decomposition of the oil mist and carbon particles adhered on the surface of the optical window, and to maintain the combustion window of the combustion chamber for a long period of time. Still further, when such oil mist and carbon are adhered on the surface of the optical window, it is possible for the improved structure to easily remove the oil mist and carbon from the surface of the optical window.

DESCRIPTION OF EMBODIMENTS

First Exemplary Embodiment

Figure 1:
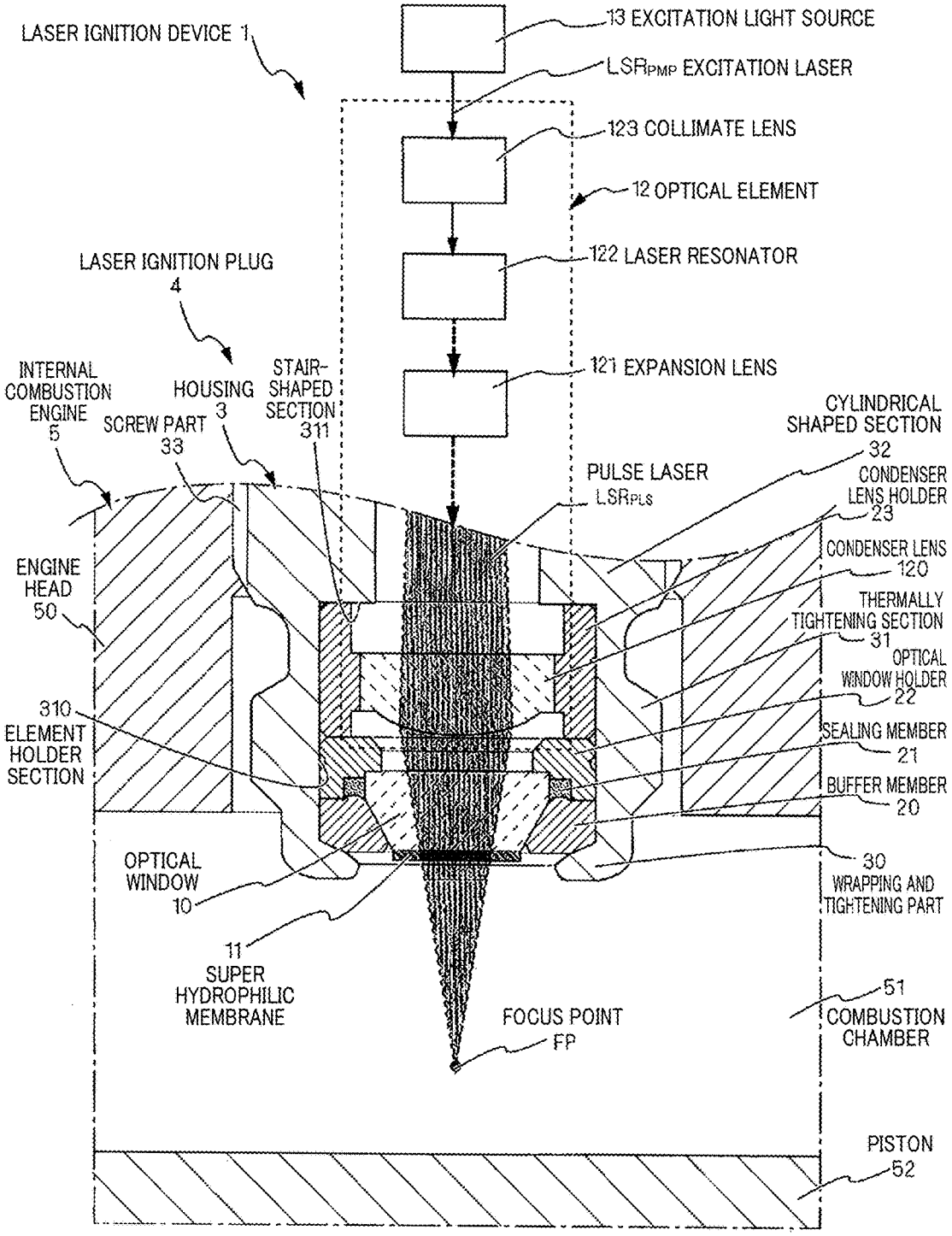
FIG. 1 is a view showing a vertical cross section of a partial portion of a laser ignition device according to a first exemplary embodiment of the present invention.

Next, a description will be given of the ignition device according to the first exemplary embodiment of the present invention with reference to FIG. 1.

The ignition device according to the first exemplary embodiment is a laser ignition device 1 with a laser ignition plug 4. The laser ignition plug 4 is mounted in a wall of a combustion chamber 51 of an internal combustion engine 5. The internal combustion engine 5 has an engine head part (a combustion engine wall) 50, cylinders (not shown) and pistons 52. The engine head part 50 covers the upper surfaces of the cylinders. The pistons 52 move vertically in the cylinders. A combustion chamber 51 is formed by the cylinder and the piston 52. A fuel mixture gas is introduced into the combustion chamber 51. The fuel mixture gas is burned in the cylinders to create heat energy, and the fuel mixture gas expands in the cylinders to create a potential energy. The piston 52 converts the generated potential energy to mechanical power. It is possible for the internal combustion engine 5 according to the present invention to use fuel gas such as propane gas, and liquid fuel such as gasoline, light oil. etc.

The laser ignition device 1 generates a pulse laser $LSR_{PLS}$ having a high energy density and irradiates the generated pulse laser $LSR_{PLS}$ to the inside of the combustion chamber 51 of the internal combustion engine 5 through an optical window 10 (as a plug forming member). The optical window 10 is arranged between the combustion chamber 51 and the laser ignition device 1. The laser ignition device 1 condenses the pulse laser $LSR_{PLS}$ to a focus point FP at a predetermined position in the combustion chamber 51 so as to ignite a fuel mixture gas introduced in the inside of the combustion chamber 51.

Figure 2A:
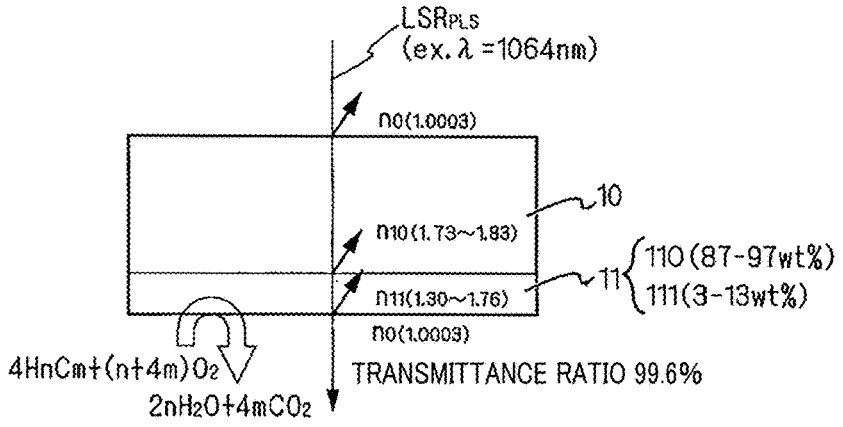
FIG. 2A is a schematic view showing a function of a super hydrophilic membrane as a part of the present invention.

The laser ignition device 1 has an excitation light source 13 and a laser ignition plug 4. The laser ignition plug 4 is composed of plug forming members. The surface of the plug forming member of the laser ignition plug 4, which is arranged to face the combustion chamber 51, is covered with a super hydrophilic membrane 11. As shown in FIG. 2A, the super hydrophilic membrane 11 contains super hydrophilic particles 110 and thermal excitation catalyst particles 111.

The laser ignition plug 4 has a housing 3 having a cylindrical shape, an optical element 12, and the optical window 10. The housing 3 is fixed to the engine head part 50 which is the wall of the combustion chamber 51 in the internal combustion engine 5. The optical element 12 is arranged in and supported by the housing 3. The optical window 10 is arranged at a boundary, which is a front end side of the housing 3, between the combustion chamber 51 and the laser ignition plug 4. The laser ignition device 1 has a structure in which the super hydrophilic membrane 11 is formed on a surface of the optical window 10 at the combustion chamber 51 side. Furthermore, the structure of the super hydrophilic membrane 11 satisfies a relationship of $\theta_{W2}<\theta_{W1}$, where $\theta_{W1}$ indicates a water contact angle between the optical window 10 without the super hydrophilic membrane 11 and water, and $\theta_{W2}$ indicates a water contact angle between the optical window 10 with the super hydrophilic membrane 11 and water. The super hydrophilic membrane 11 is made of super hydrophilic particles 110 and the thermal excitation catalyst particles 111. The super hydrophilic particles 110 and the thermal excitation catalyst particles 111 are a mixture having a predetermined composition ratio. The super hydrophilic particles 110 have a particle size of not more than a predetermined particle size. The thermal excitation catalyst particles 111 have a particle size of not more than a predetermined particle size. It is preferable to form, on the surface of the optical window 10, the super hydrophilic membrane 11 having the water contact angle $\theta_{W1}$ between the optical window 10 and water is not more than ⅔. That is, it is preferable for the super hydrophilic membrane 11 to have a relative water contact angle $\theta_{W2}/\theta_{W1}$ of not more than ⅔, where $\theta_{W1}$ indicates the water contact angle between the optical window 10 having no super hydrophilic membrane and water, and $\theta_{W2}$ indicates the water contact angle between the optical window 10 having the super hydrophilic membrane 11 and water.

Furthermore, the super hydrophilic membrane 11 has a relationship of $\theta_{O2}>\theta_{O1}$, where $\theta_{O1}$ indicates an oil contact angle between the optical window 10 having no super hydrophilic membrane and oil, and $\theta_{O2}$ indicates an oil contact angle between the optical window 10 having the super hydrophilic membrane 11 and oil.

It is preferable for the super hydrophilic membrane 11 to have an oil repellency which is capable of increasing the oil contact angle $\theta_{O1}$ between the optical window 10 and oil by a factor of not less than 1.5.

That is, it is preferable for the super hydrophilic membrane 11 to have a relative oil contact angle $\theta_{O2}/\theta_{O1}$ of not less than 1.5, where $\theta_{O1}$ indicates the oil contact angle between the optical window 10 having no super hydrophilic membrane and oil, and $\theta_{o2}$ indicates the oil contact angle between the optical window 10 having the super hydrophilic membrane 11 and oil.

It is preferable for the super hydrophilic membrane 11 to have a composition ratio of not more than 47% of the thermal excitation catalyst particles 111 in a total sum of the super hydrophilic particles 110 and the thermal excitation catalyst particles 111, and more preferable to have the composition ratio of not more than 20% of the thermal excitation catalyst particles 111.

The super hydrophilic membrane 11 is made of the super hydrophilic particles 110, the thermal excitation catalyst particles 111, and a membrane formation material such as a binder, a hardener, etc. The membrane formation material is a binder component which contains not less than one kind material selected from phosphate and metal oxide, so as to increase the adhesiveness of the super hydrophilic particles 110 and the thermal excitation catalyst particles 111. Specifically, in the super hydrophilic membrane 11, the super hydrophilic particles 110 contain silica ($SiO_2$), and the thermal excitation catalyst particles 111 contain not less than one kind selected from transition metal oxide and tin oxide. The transition metal oxide is at least one or more kinds selected from $TiO_2$, $ZrO_2$, $Cr_2O_3$, $Y_2O_3$, ZnO, $CeO_2$, $Ta_2O_5$, $CuO_2$, CuO and $WO_3$.

As an example, the super hydrophilic membrane 11 is made of a mixture of a main material and a hardener which have a weight ratio of 1:1. The main material is made of aluminum phosphate ($AlPO_4$) within a range of 4 wt % to 6 wt %, silica ($SiO_2$) within a range of 90 wt % to 95 wt %, alumina ($Al_2O_3$) within a range of 1.0 wt % to 1.5 wt %, and zinc oxide (ZnO) within a range of 0.3 wt % to 0.7 wt %.

The hardener is made of sodium oxide ($Na_2O_3$) of 2.0 wt %, potassium oxide ($K_2O$) of 82.2 wt % and silicone ($nSiO_2$) of 15.8 wt %.

It is preferable for the thermal excitation catalyst particles 111 which have been mixed with the super hydrophilic particles 110 in the super hydrophilic membrane 11 to contain not less than one kind selected from titania ($TiO_2$), ceria ($CeO_2$) and tin oxide ($SnO_2$).

The experimental results and study by the inventors of the present invention provide that it is possible for the super hydrophilic membrane 11 to have superior characteristics when titania within a range of 3.0 wt % to 13.0 wt % to the content of silica as the main material is used as the thermal excitation catalyst particles 111 in the super hydrophilic membrane 11.

Specifically, it is preferable for the super hydrophilic membrane 11 to contain the super hydrophilic particles 110 having a particle size of not more than 450 nm and within a range of 87 wt % to 97 wt %, and to contain the thermal excitation catalyst particles 111 having a particle size of not more than 450 nm and within a range of 3 wt % to 13 wt %.

The inventors of the present invention have observed the variation of the water contact angle and the oil contact angle of each of plural test samples of the super hydrophilic membrane 11 to water and oil. The test samples of the super hydrophilic membrane 11 have a different composition ratio of the super hydrophilic particles 110 and the thermal excitation catalyst particles 111.

When $\theta_{W1}$ indicates the water contact angle between the optical window 10 having no super hydrophilic membrane and water, and $\theta_{W2}$ indicates the water contact angle between the optical window 10 having the super hydrophilic membrane 11 and water, it is determined for a range of not more than ⅔ of the relative water contact water angle $\theta_{W2}/\theta_{W1}$ to have improved super hydrophilic effects.

Similarly, when $\theta_{O1}$ indicates the oil contact angle between the optical window 10 having no super hydrophilic membrane and oil, and $\theta_{O2}$ indicates the oil contact angle between the optical window 10 having the super hydrophilic membrane 11 and oil, it is determined for a range of not less than 1.5 times the relative oil contact water angle $\theta_{O2}/\theta_{O1}$ to have oil repellent effects.

The experimental results and study by the inventors of the present invention provide that in order to satisfy the preferable ranges previously described, it is preferable for the super hydrophilic membrane 11 to contain the super hydrophilic particles 110 having a particle size of not more than 450 nm, and the thermal excitation catalyst particles 111 having a particle size of not more than 450 nm and within a range of 3 wt % to 13 wt %.

It is possible for the super hydrophilic membrane 11 to have the water contact angle $\theta_{W2}$ between the optical window 10 having the super hydrophilic membrane 11 and water which is not more than ⅔ of the water contact angle $\theta_{W1}$ between the optical window 10 having no super hydrophilic membrane and water. This structure makes it possible to spread condensed water, which has been contained in exhaust gas and adhered on the surface of the optical window 10, and to float oil mist adhered on the surface of the optical window 10 using the spread water.

Further, even if oil mist present in the combustion chamber 51 is adhered on the surface of the optical window 10, it is possible to completely oxidize and decompose hydrocarbon as main component of oil mist by the presence of the thermal excitation catalyst particles 111 in the super hydrophilic membrane 11. Still further, even if oil mist contains non-combustible metal and metal oxide is thereby generated, it is possible to float the generated metal oxide and to easily remove the generated metal oxide from the surface of the optical window 10 by the water spread on the surface of the optical window 10 because the super hydrophilic membrane 11 has the excellent super hydrophilic characteristics. This makes it possible to suppress oil mist from being adhered and accumulated on the surface of the optical window 10.

It is possible to have the same as the effects previously described if the internal combustion engine uses a liquid fuel, and exhaust gas emitted from the internal combustion engine contains soot, etc. due to incomplete combustion. That is, even if soot is adhered and accumulated on the surface of the optical window 10, it is possible to float and remove the soot and be easily eliminated from the surface of the optical window 10. Further, it is possible to have the effects for oxidizing and completely decomposing carbon as the main component of soot by the catalysis of the thermal excitation catalyst particles 111.

The excitation light source 13 is composed of a semiconductor laser diode, etc. Such a semiconductor laser diode is made of crystal materials such as GaAlAs, InGaAs, etc. which are widely known.

The excitation light source 13 oscillates an excitation laser $LSR_{PMP}$ having a predetermined wavelength. It is possible to combine and use plural semiconductor laser diodes as the excitation light source 13.

The optical element 12 is composed of a collimator lens 123, a laser resonator 122, an expansion lens 121 and a condenser lens 120 which have been known. The optical element 12 is protected from a high temperature and high pressure in the combustion chamber by the optical window 10. The optical element 12 is also referred to as the laser element. The expansion lens 121 is also referred to as the beam expansion unit.

The excitation laser $LSR_{PMP}$ oscillated by the excitation light source 13 is collimated to a parallel light by the collimator lens 123. The laser resonator 122 receives the parallel light transmitted from the collimator lens 123. The collimator lens 123 is made of a known optical material such as optical glass, heat resistant glass, quartz glass, sapphire glass, etc. An antireflection film is formed on the surface of the collimator lens 123 as necessary. It is acceptable for the collimator lens 123 to have a combination of plural lenses or an assembly of lenses.

It is possible to use a known passive Q switch type laser resonator as the laser resonator 122. The laser resonator 122 is composed of a laser medium, an anti-reflection film arranged an incident side of the laser medium, a total reflection mirror, a saturation absorbing material arranged at an emitting side of the laser medium, and an emitting mirror composed of a partial reflection mirror.

It is possible to use, as the laser medium, a known laser medium such as Nd: YAG in which Nd has been doped in YAG single crystal. The total reflection mirror has specific characteristics through which a pulse laser $LSR_{PMP}$ having a short wavelength penetrates, i.e. passes, and by which the pulse laser $LSR_{PLS}$ having a long wavelength is totally reflected. It is possible to use, as the saturation absorbing material, Cr: YAG in which $Cr^{4+}$ has been doped in YAG single crystal.

When the laser resonator 122 receives the excitation laser $LSR_{PMP}$, Nd in the laser medium is excited to emit a laser having a wavelength of 1,064 nm, for example. The laser having the wavelength of 1,064 nm is accumulated in the laser medium. When the energy stored in the laser medium reaches a predetermined energy level, the laser resonator 122 emits the pulse laser $LSR_{PLS}$ having a high energy density through the output mirror arranged at the front end side of the laser resonator 122.

The pulse laser $LSR_{PLS}$ emitted from the laser resonator 122 is expanded by the expansion lens 121, and condensed by the condenser lens 120 so as to increase the energy density of the pulse laser $LSR_{PLS}$, at the focus point FP, i.e. condensed point. This makes it possible to produce a plasma of the fuel mixture gas around the focus point in the combustion chamber, and to generate a flame kernel.

It is possible to use, as the expansion lens 121 and the condenser lens 120, known optical material such as optical glass, heat resistant glass, quartz glass, sapphire glass, etc.

The housing 3 is made of heat resistant metal member such as iron, nickel, iron-nickel alloy, stainless steel, etc. The housing 3 has a cylindrical shape in which the optical element 12 is held and fixed. The optical window 10 is arranged at the front end side of the housing 3.

The condenser lens 120 is held in and supported by a condenser lens holder 23 having a cylindrical shape. The condenser lens holder 23 is arranged in an element holder section 310. This element holder section 310 is formed at a front end side of a cylindrical shaped section 32 of the housing 3 having a cylindrical shape in which a screw part 33 is formed so as to screw the cylindrical shaped section 32 to the engine head part 50. Because a tightening stress generated by the screw part 33 is not applied to the condenser lens holder 23, no distortion is generated at an optical axis of the condenser lens 120.

The optical window 10 is made of known transparent heat resistant glass such as sapphire glass, quartz glass, etc. The optical window 10 has a structure in which an incident surface and an output surface are arranged parallel to each other, and a tapered surface is formed at an outer circumferential surface toward the front end side. The incident surface of the optical window 10 is arranged at the distal end of the optical window 10 so as to face the condenser lens 120. The output surface of the optical window 10 is arranged at the front side of the optical window 10 so as to face the combustion chamber 51.

The optical window 10 is held in an optical window holder 22 having a cylindrical shape with a stair-shaped structure at the distal end side of the optical window 10. The optical window 10 is further fixed to the optical window holder 22 by using a sealing member. A cushioning member 20 of a circular shape is arranged to cover the tapered surface formed at the front end side of the optical window 10.

The cushioning member 20 is made of metal member having a thermal expansion coefficient which is greater than that of the member forming the housing 3. The optical window 10 is pressed to an axial direction of the optical window 10 and elastically supported through the cushioning member 20 by a wrapping and tightening part 30 arranged at the front end side of the housing 3.

A flat surface part at the distal end side of the condenser lens holder 23 having a cylindrical shape is in contact with a stair-shaped section 311 in the cylindrical shaped section 32. A flat surface part at the front end side of the condenser lens holder 23 is in contact with a flat surface part at the distal end side of the optical window holder 22 having a cylindrical shape. A flat surface part at the front end side of the optical window holder 22 is in contact with a flat surface part at the distal end side of the cushioning member 20.

The condenser lens holder 23, the optical window holder 22 and the cushioning member 20 arranged along an axial direction are supported by the stair-shaped section 311 and the wrapping and tightening part 30 to form a thermally tightening section 31. The thermally tightening section 31 generates an axial force and elastically supports condenser lens holder 23, the optical window holder 22 and the cushioning member 20.

(Production method) A description will be given of a brief explanation of the method of producing the super hydrophilic membrane 11 to be used in the laser ignition device 1 and the spark ignition device 6. The spark ignition device 6 will be described later.

It is possible to produce the super hydrophilic membrane 11 by mixing a main material and a hardener which have a weight ratio of 1:1. The main material is made of aluminum phosphate ($AlPO_4$), sapphire (i.e. alumina $Al_2O_3$), silica ($SiO_2$), and zinc oxide (ZnO) as shown in Table 1. The hardener is made of sodium oxide ($Na_2O_3$) potassium oxide ($K_2O$) and silicone ($nSiO_2$) as shown in Table 2.

As shown in Table 1, the main material contains, as a base component thereof, silica ($SiO_2$) having a particle size of not more than 450 nm and within a range of 90 wt % to 95 wt %. As shown in Table 2, the hardener contains, as a base component thereof, potassium oxide ($K_2O$) within a range of 80 to 85 wt %.

The super hydrophilic membrane 11 further contains colloid particles having a particle size of not more than 450 nm in addition to the super hydrophilic particles 110 such as aluminum phosphate, silica, sapphire (i.e. alumina), zinc oxide, etc.

So as to promote the catalysis of the super hydrophilic membrane 11, the thermal excitation catalyst particles 111 having a predetermined composition ratio are added to and mixed with the super hydrophilic particles 110 to produce the super hydrophilic membrane 11. It is possible to use, as a thermal excitation catalyst, collide particles having a particle size of not more than 450 nm which is at least one or more kinds selected from titania ($TiO_2$), ceria ($CeO_2$) and tin oxide ($SnO_2$).

The super hydrophilic particles 110 within a range of 87 wt % to 97 wt % and thermal excitation catalyst particles 111 as the thermal excitation catalyst precursor material within a range of 3 wt % to 13 wt %, are mixed. The obtained mixture is dispersed in water to produce a slurry. The obtained slurry is dripped on a surface of a glass member which forms the optical window 10. This glass member is then rotated at a predetermined rotation speed (for example, within a range of 2000 r.p.m. to 25000 r.p.m.) over two minutes to form a thin film on the glass member as the optical window 10.

Next, the glass member is dried at the room temperature, and burned at a predetermined temperature (for example, within a range of 350° C. to 500° C.). This produces the super hydrophilic membrane 11 which contains the thermal excitation catalyst particles 111 having a predetermined content ratio, as a main component of the present invention.

As shown in FIG. 2A, the super hydrophilic membrane 11 formed on the surface of the optical window 10 is made of a thin film having a refractive index n11 (for example, which is within a range of 1.30 to 1.76) through which a pulse laser having a predetermined wavelength (for example, Nd: YAG laser having a fundamental wavelength A=1064 nm) can penetrate. (This thin film as the super hydrophilic membrane 11 formed on the optical window 10 has an optical thickness n11d=λ/4 nm=266 nm, and a film thickness d within a range of 151 to 240 nm.), where air has the refractive index n0=1.0003, the optical window 10 has a refractive index n10 within a range of 1.73 to 1.83 when sapphire (i.e. alumina) is used.

When irradiating a pulse laser having the predetermined wavelength on the optical window 10 having the structure previously described, it is sufficient for the thin film as the super hydrophilic membrane 11 to have the optical thickness n11d of not more than 266 nm so as to have its maximum transmittance (for example, 99.6%). However, it is preferable for the thin film to have the optical thickness n11d within a range of 151 to 240 nm with consideration for its durability and the production variations.

When hydrocarbons (4HnCm) are contacted with the super hydrophilic membrane 11, a chemical reaction occurs between hydrocarbons and oxygen by the thermal excitation catalyst particles 111, and produces water and carbon dioxide. Because the super hydrophilic membrane 11 can absorb a part of generated water, the super hydrophilic membrane 11 provides an oil repellence function. As a result, because the super hydrophilic membrane 11 reduces the amount of the hydrocarbons adhered on the super hydrophilic membrane 11, this makes it possible to prevent the transmittance of the pulse laser from reducing.

As shown in Table 3, it is acceptable for the mixing ratio of the components forming the main material to have a predetermined margin. It is also possible to use materials shown in Table 4 as the thermal excitation catalyst particles 111. The experimental results and study provide that it is possible for the thin film made of the super hydrophilic membrane 11 to have good acid resistant and alkali resistant, the stable super hydrophilic characteristics and thermal excitation catalysis when using titania, ceria and tin oxide.

Because the evaluation result of chromium oxide ($Cr_2O_3$) shown in Table 4 varies due to the fundamental wavelength of Nd: YAG laser as previously described, those evaluation results of such chromium oxide shown in Table 4 do not affect cases when using another pulse laser having a different fundamental wavelength.

TABLE 1

| Main material 50 wt % | | | |
|---|---|---|---|
| Components | Molecular weight | Weight (g) | Ratio of weight (wt %) |
| $AlPO_4$ | 122.0 | 96.1 | 5.6 |
| $SiO_2$ | 60.1 | 1597.1 | 92.6 |
| $Al_2O_3$ | 102.0 | 23 | 1.3 |
| ZnO | 81.4 | 9.2 | 0.5 |
| | Total weight | 1725.4 | 100.0 |

TABLE 2

| Hardener 50 wt % | | | |
|---|---|---|---|
| Components | Molecular weight | Weight (g) | Ratio of weight (wt %) |
| $Na_2O$ | 62.0 | 39.4 | 2.0 |
| $K_2O$ | 94.2 | 1410.8 | 82.2 |
| $nSiO_2$ | 60.1 | 270.4 | 15.8 |
| | Total weight | 1716.1 | 100.0 |

TABLE 3

| Permissible range of Main material | | | |
|---|---|---|---|
| Components | Ratio of weight (wt %) | Upper limit | Lower limit |
| $AlPO_4$ | 5.6 | 4.0 | 6.0 |
| $SiO_2$ | 92.6 | 90.0 | 95.0 |
| $Al_2O_3$ | 1.3 | 1.0 | 1.5 |
| ZnO | 0.5 | 0.3 | 0.7 |
| | 100.0 | 0.0 | 0.0 |

TABLE 4

| Material | Melting point (°) | | Transmission wavelength (nm) | Water soluble | Functions |
|---|---|---|---|---|---|
| $ZrO_2$ | 2,677 | ○ | 360-5,100 | ○ | Thermal excitation catalyst |
| $Cr_2O_3$ | 2,435 | X | 1200-10,000 | ○ | Thermal excitation catalyst |
| $Y_2O_3$ | 2,410 | ○ | 200-12,000 | ○ | Thermal excitation catalyst |
| $Al_2O_3$ | 2,015 | ○ | 150-5,500 | ○ | Protection glass |
| ZnO | 1,975 | ○ | 450-4,000 | ○ | Thermal excitation catalyst |
| $CeO_2$ | 1,950 | ○ | 400-12,000 | ○ | Thermal excitation catalyst |
| $TiO_2$ | 1,850 | ○ | 430-15,000 | ○ | Thermal excitation catalyst |
| $SiO_2$ | 1,650 | ○ | 160-30,000 | ○ | Super hydrophilic |
| $SnO_2$ | 1,630 | ○ | Transparent not less | ○ | Thermal excitation catalyst |

TABLE 4-continued

| Material | Melting point (°) | | Transmission wavelength (nm) | Water soluble | Functions |
|---|---|---|---|---|---|
| | | | than 1,060 nm | | |
| $Ta_2O_5$ | 1,468 | ○ | 300-10,000 | ○ | Thermal excitation catalyst |
| $WO_3$ | 1,473 | ○ | Not less than 400 | ○ | Thermal excitation catalyst |
| $Cu_2O$ | 1,235 | ○ | Not less than 590 | ○ | Thermal excitation catalyst |
| CuO | 1,201 | Δ | Not less than 1,033 | Δ | Thermal excitation catalyst |

Figure 2B:
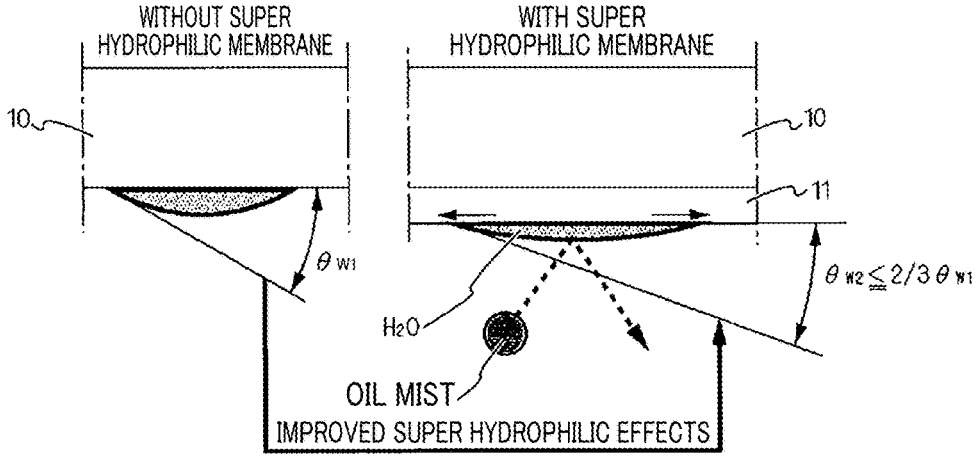
FIG. 2B is a schematic view showing hydrophilicity of the super hydrophilic membrane as a part of the present invention.

As shown in FIG. 2B, it is possible that the formation of the super hydrophilic membrane 11 reduces the water contact angle $\theta_{W1}$ to the water contact angle $\theta_{W2}$ which is not more than ⅔ of the water contact angle $\theta_{W1}$, where the water contact angle $\theta_{W1}$ represents the contact angle between the optical window 10 and water. This structure makes it possible to improve super hydrophilic membrane ability of the optical window 10. When water in the inside of the combustion chamber 52 is adhered on the surface of the optical window 10, the water is spread on the surface of the optical window 10. This makes it possible to suppress oil mist from being adhered and accumulated on the surface of the optical window 10.

Figure 2C:
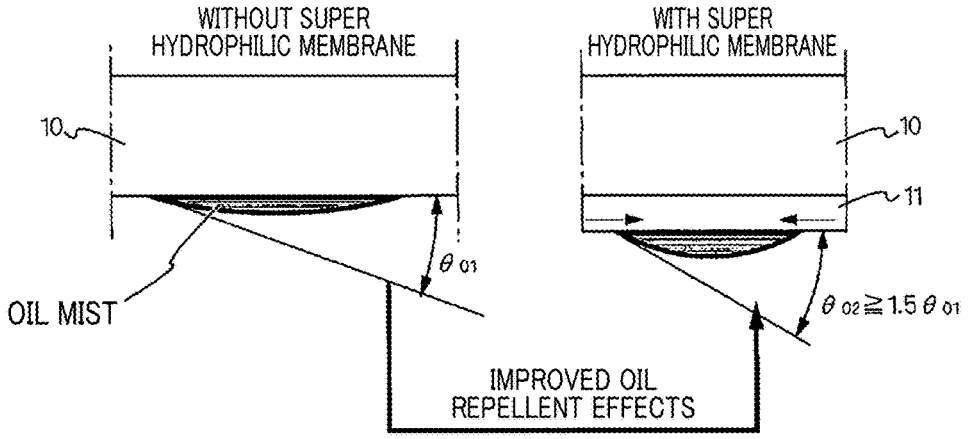
FIG. 2C is a schematic view showing of oil repellent of the super hydrophilic membrane as a part of the present invention.

Furthermore, as shown in FIG. 2C, the formation of the super hydrophilic membrane 11 makes it possible to increase the contact angle $\theta_{O1}$ between the optical window 10 and oil to the water contact angle $\theta_{O2}$ which is not less than 1.5 times the water contact angle $\theta_{O1}$. This structure makes it possible to improve the oil repellent effects of the optical window 10. As a result, it is possible to easily remove and eliminate oil mist, which has been adhered and accumulated on the surface of the optical window 10, from the surface of the optical window 10.

A description will now be given of the influence on the super hydrophilic function and the oil repellent effects of the super hydrophilic membrane 11 of variations of the composition ratio of titania as the thermal excitation catalyst with reference to FIG. 3A and FIG. 3B. The composition ratio of titania is represented by a weight ratio (%) of a weight of the super hydrophilic membrane to a weight of silica.

Figure 3A:
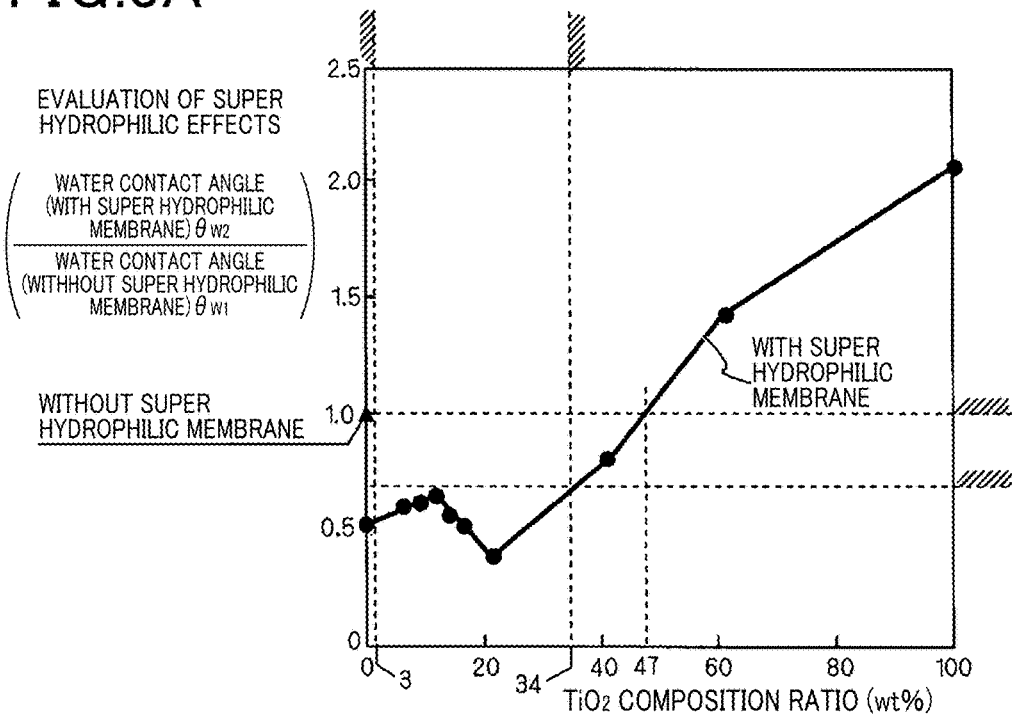
FIG. 3A is a characteristics view showing effects of a titania mixing ratio to the hydrophilicity of the super hydrophilic membrane.

As shown in FIG. 3A, it can be recognized that the water contact angle $\theta_{W2}$ becomes not more than ⅔ of the water contact angle $\theta_{W1}$ when titania having a composition ratio of not more than 34 wt % and silica are mixed to the total weight of silica and titania in the super hydrophilic membrane 11, where $\theta_{W1}$ indicates the water contact angle between the optical window 10 and water if no super hydrophilic membrane 11 is formed on the surface of the super hydrophilic membrane 11, and $\theta_{W2}$ indicates the water contact angle between the optical window 10 and water if the super hydrophilic membrane 11 is formed on the surface of the super hydrophilic membrane 11.

In this structure, the higher the composition ratio of titania, the more the super hydrophilic function of the super hydrophilic membrane 11 is reduced. On the other hand, when the composition ratio of titania exceeds 47 wt %, the water contact angle $\theta_{W2}$ becomes greater than the water contact angle $\theta_{W1}$ when the optical window 10 has no super hydrophilic membrane 11.

Figure 3B:
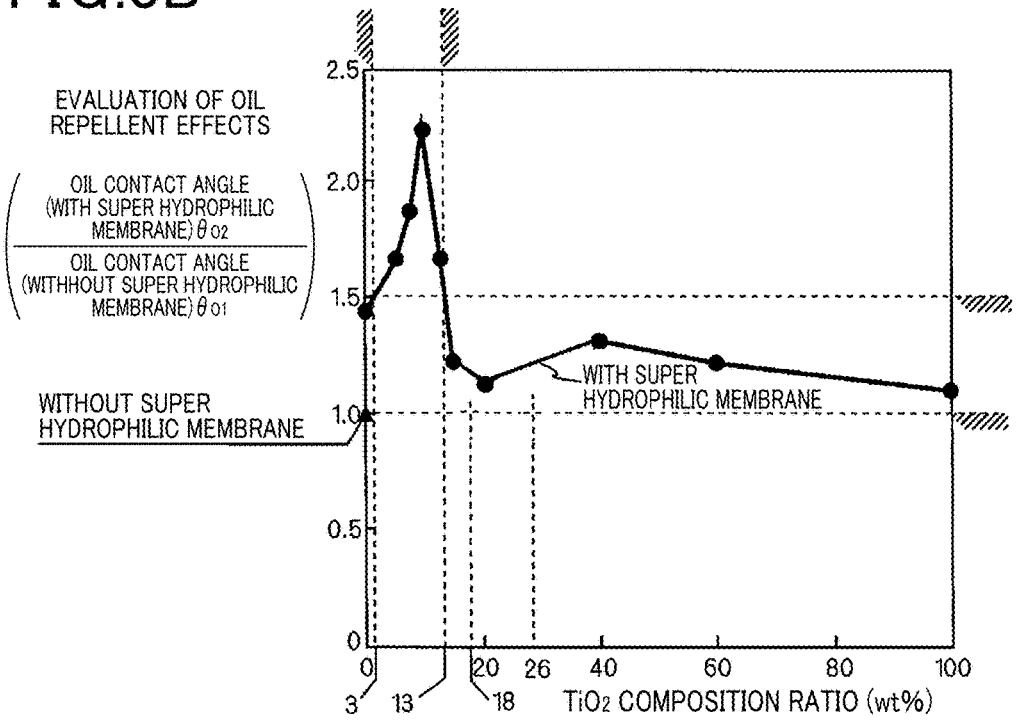
FIG. 3B is a characteristics view showing effects of the titania mixing ratio to the oil repellent of the super hydrophilic membrane.

Furthermore, as shown in FIG. 3B, it can be recognized that the oil contact angle $\theta_{O2}$ becomes not less than 1.5 times the oil contact angle $\theta_{O1}$ when titania having a composition ratio within a range of 3% to 13% and silica are mixed to the total weight of silica and titania in the super hydrophilic membrane 11, where $\theta_{O1}$ indicates the oil contact angle between the optical window 10 and oil (engine oil) if no super hydrophilic membrane 11 is formed on the surface of the super hydrophilic membrane 11, and 002 indicates the oil contact angle between the optical window 10 and oil if the super hydrophilic membrane 11 is formed on the surface of the super hydrophilic membrane 11.

In this structure, the higher the composition ratio of titania, the more the oil repellent effects of the super hydrophilic membrane 11 is reduced. On the other hand, when the composition ratio of titania exceeds 20 wt % and in particular, not less than 40 wt %, the oil repellent effects of the super hydrophilic membrane 11 becomes approximately constant.

On the basis of the obtained experimental results, it can be understood that it is good for titania as the thermal excitation catalyst particles 111 to have the composition ratio of not less than 3 wt %, and not more than 20 wt %, and more preferable to have the composition ratio of not more than 13 wt %. It is possible to easily remove and eliminate oil mist from the surface of the optical window 10 at the combustion chamber side when the water contact angle is reduced, and the oil contact angle is increased.

As previously described, the first exemplary embodiment shows the laser ignition device 1 having the structure in which the optical window 10 is arranged directly facing the combustion chamber 51 of the internal combustion engine 5. It is also possible for the laser ignition device 1 to have another structure in which an auxiliary combustion chamber is formed between the optical window 10 and the combustion chamber 51, and the auxiliary combustion chamber has an injection hole which is communicated with the combustion chamber. In this structure, a part of the fuel mixture gas is introduced in the auxiliary combustion chamber, and the pulse laser $LSR_{PLS}$ is focused at an inside point of the auxiliary combustion chamber so as to ignite the fuel mixture gas in the auxiliary combustion chamber and to inject a generated flame kernel from the auxiliary combustion chamber to the inside of the combustion chamber 51. This also makes it possible to ignite the internal combustion engine 5.

Still further, the first exemplary embodiment shows the laser ignition device 1 having the structure in which the super hydrophilic membrane 11 is formed directly on the surface of the optical window 10 at the combustion chamber side. It is also acceptable to form an anti-reflection film between the optical window 10 and the super hydrophilic membrane 11 so as to increase the transmittance ratio of the pulse laser $LSR_{PLS}$.

Second Exemplary Embodiment

Hereinafter, a description will be given of the ignition device according to the second exemplary embodiment with reference to FIG. 4 to FIG. 12.

The ignition device according to the second exemplary embodiment is a spark ignition device 6. The spark ignition device 6 has a spark ignition plug 60 as the ignition plug mounted in the wall of the combustion chamber 51. The internal combustion engine 5 to which the spark ignition device 6 is applied has the same structure of the internal combustion engine 5 used in the first exemplary embodiment previously described. Accordingly, the same components will be designated by the same reference numbers and characters, and the explanation of the same components is omitted for brevity. The different between the second exemplary embodiment and the first exemplary embodiment will be explained.

The spark ignition device 6 is composed of the spark ignition plug 60 and a power supply section 8 which supplies electric power to the spark ignition plug 60. The spark ignition device 6 is arranged to project the inside of the combustion chamber 51. In the spark ignition plug 60, a predetermined gap G is formed between electrodes. When receiving high voltage, a spark discharge is generated in the gap G so as to ignite the fuel mixture gas introduced in the inside of the combustion chamber 51. A surface of the plug forming member which forms the spark ignition plug 60, which face the combustion chamber 51 side, is covered with the super hydrophilic membrane 11. The super hydrophilic membrane 11 contains super hydrophilic particles 110 and thermal excitation catalyst particles 111 (for example, see FIG. 2A).

The spark ignition plug 60 has a housing 63 having a cylindrical shape, a central electrode 61, an insulator 7 (as the plug forming member) and a ground electrode 62 fixed to the housing 63. The insulator 7 has a cylindrical shape and supports the outer periphery of the central electrode 61. The insulator 7 is arranged in and supported by the housing 63 so that the central electrode 61 having a rod shape is coaxially arranged in an axial hole 71 in the insulator 7. The axial hole 71 extends along an axial direction of the insulator 7. The distal end side of the insulator 7 is sealed. The insulator 7 is accommodated in the housing 63.

A front side part of the ground electrode 62 is curved inwardly in a L character shape and faces the front end side of the central electrode 61 to form the predetermined gap G between the central electrode 61 and the ground electrode 62. The distal end side of the ground electrode 62 is fixed to the front end surface of the housing 63 by welding.

The housing 63 of the spark ignition plug 60 has a screw section and a stair-shaped section 64. The screw section is formed at outer periphery side thereof, by which the spark ignition plug 60 is fixed. The stair-shaped section 64 is formed at the inner peripheral side so as to support an intermediate section 72 having a wide diameter in the insulator 7. The distal end side of the housing 63 is fixed to the outer periphery side of the insulator 7 by a screw section to be sealed. The sealing member (not shown) and an electrode terminal section are arranged and accommodated in the distal end side of the insulator 7. The power supply section 8 supplies electric power to the central electrode 61 through the electrode terminal section. The front end section of the insulator 7, when viewed from the stair-shaped section 64, has a tapered shape in which the diameter of the insulator 7 is gradually reduced toward the front end side of the insulator 7. A gap 73 is formed between the insulator 7 and the housing 63.

For example, the insulator 7 is made of insulation ceramic materials such as alumina, silica, etc. The housing 63 is made of steel, etc. The central electrode 61 is made of nickel alloy, etc. An alloy chip is formed and fixed at the front end part of the central electrode 61 by welding. For example, the alloy chip is made of an alloy containing iridium, etc. The ground electrode 62 is made of nickel alloy, etc.

Figure 4:
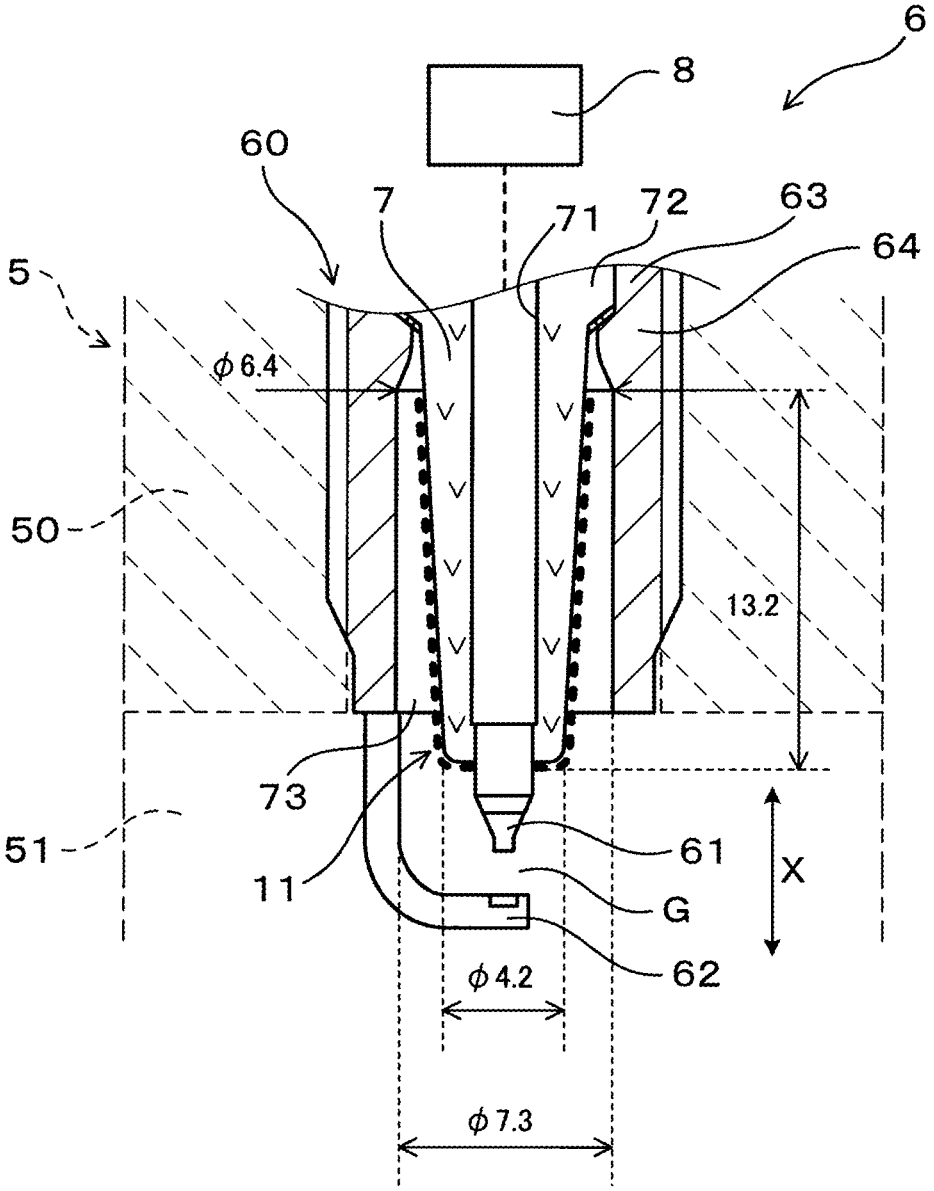
FIG. 4 is a vertical cross sectional view showing a part of a spark ignition device according to a second exemplary embodiment of the present invention.

As shown in FIG. 4, the spark ignition device 6 according to the second exemplary embodiment has the structure in which the insulator 7 is the plug forming member which forms the spark ignition plug 60, and the super hydrophilic membrane 11 is formed on the surface of the insulator 7, which faces the combustion chamber 51. Specifically, as shown in FIG. 4, the super hydrophilic membrane 11 is formed approximately on the overall surface of the insulator 8 at the front side part of the spark ignition plug 60. The super hydrophilic membrane 11 has the same structure of the super hydrophilic membrane 11 used in the first exemplary embodiment previously described. That is, the structure of the super hydrophilic membrane 11 satisfies a relationship of $\theta_{W2}<\theta_{W1}$, where $\theta_{W1}$ indicates the water contact angle between the optical window 10 without the super hydrophilic membrane 11 and water, and $\theta_{W2}$ indicates the water contact angle between the optical window 10 with the super hydrophilic membrane 11 and water. It is preferable for the super hydrophilic membrane 11 to have the relative water contact angle $\theta_{W2}/\theta_{W1}$ of not more than ⅔, where $\theta_{W1}$ indicates the water contact angle between the optical window 10 having no super hydrophilic membrane and water, and $\theta_{W2}$ indicates the water contact angle between the optical window 10 having the super hydrophilic membrane 11 and water. (See FIG. 2B, for example.)

Furthermore, the super hydrophilic membrane 11 has the relationship of $\theta_{O2}>\theta_{O1}$ where $\theta_{O1}$ indicates the oil contact angle between the optical window 10 having no super hydrophilic membrane and oil, and $\theta_{O2}$ indicates the oil contact angle between the optical window 10 having the super hydrophilic membrane 11 and oil.

It is preferable for the super hydrophilic membrane 11 to have oil repellency to increase the oil contact angle $\theta_{O1}$ between the optical window 10 and oil by not less than 1.5 times. That is, it is preferable for the super hydrophilic membrane 11 to have the relative oil contact angle $\theta_{O2}/\theta_{O1}$ of not less than 1.5. (For example, see FIG. 2C)

It is preferable for the super hydrophilic membrane 11 to have a composition ratio of not more than 47% of the thermal excitation catalyst particles 111 in a total sum of the super hydrophilic particles 110 and the thermal excitation catalyst particles 111, and more preferable to have the composition ratio of not more than 20% of the thermal excitation catalyst particles 111.

The super hydrophilic membrane 11 is made of the super hydrophilic particles 110, the thermal excitation catalyst particles 111, and a membrane formation material such as a binder, a hardener, etc. The membrane formation material is a binder component which contains not less than one kind material selected from phosphate and metal oxide, so as to increase the adhesiveness of the super hydrophilic particles 110 and the thermal excitation catalyst particles 111. Specifically, in the super hydrophilic membrane 11, the super hydrophilic particles 110 contain silica ($SiO_2$), and the thermal excitation catalyst particles 111 contain not less than one kind selected from transition metal oxide and tin oxide. The transition metal oxide is not less than one kind selected from $TiO_2$, $ZrO_2$, $Cr_2O_3$, $Y_2O_3$, ZnO, $CeO_2$, $Ta_2O_5$, $CuO_2$, CuO and $WO_3$. It is preferable for the thermal excitation catalyst particles 111 which have been mixed with the super hydrophilic particles 110 in the super hydrophilic membrane 11 to contain at least one or more kinds selected from titania ($TiO_2$), ceria ($CeO_2$) and tin oxide ($SnO_2$).

The super hydrophilic membrane 11 allows the surface of the insulator 7 to have the super hydrophilic function, oil repellent effects and static electricity proof effects. The formation of the super hydrophilic membrane 11 reduces an adhesion amount of oil component and carbon on the surface of the insulator 7 and easily remove the oil mist and carbon particles from the surface of the super hydrophilic membrane 11. Still further, the thermal excitation catalyst particles 111 in the super hydrophilic membrane 11 are burning the hydrocarbon and carbon contained in the oil mist adhered on the surface of the super hydrophilic membrane 11. The super hydrophilic function and oil repellent effects vary due to a composition ratio of the super hydrophilic particles 110 and the thermal excitation catalyst particles 111.

In order to provide the excellent effects caused by the formation of the super hydrophilic membrane 11, it is preferable for the thermal excitation catalyst particles 111 to have the composition ratio of not more than 47%, and more preferable to have the composition ratio of not more than 20%.

As an example, the super hydrophilic membrane 11 is made of a mixture of a main material and a hardener which have a weight ratio of 1:1. The main material is made of aluminum phosphate ($AlPO_4$) within a range of 4 wt % to 6 wt %, silica ($SiO_2$) within a range of 90 wt % to 95 wt %, alumina ($Al_2O_3$) within a range of 1.0 wt % to 1.5 wt %, and zinc oxide (ZnO) within a range of 0.3 wt % to 0.7 wt %. The hardener is made of sodium oxide ($Na_2O_3$) of 2.0 wt %, potassium oxide ($K_2O$) of 82.2 wt % and silicone ($nSiO_2$) of 15.8 wt %.

The super hydrophilic membrane 11 is produced by mixing the thermal excitation catalyst particles 111 with a mixture of the main material and the hardener. It is possible for the second exemplary embodiment to use the same composition ratio of the super hydrophilic particles 110 and the thermal excitation catalyst particles 111 in the super hydrophilic membrane 11, and the same method of producing the super hydrophilic membrane 11, etc. according to the first exemplary embodiment.

The experimental results and study by the inventors of the present invention shows that in addition to the super hydrophilic function and the oil repellent effects, it is possible for the super hydrophilic membrane 11 to have superior carbon combustion characteristics when the thermal excitation catalyst particles 111 within a range of 3.0 wt % to 13.0 wt % to the content of silica as the main material is used in the super hydrophilic membrane 11. It is more preferable for the super hydrophilic membrane 11 to have superior ignitability and excellent ignition effects when the thermal excitation catalyst particles 111 within a range of 7.5 wt % to 15 wt % to the content of silica is used.

Experimental Example

A description will be given of the experiments of the spark ignition device 6 having the structure shown in FIG. 4.

In the experiments, the spark ignition plug 60 was produced by using the following method, in which the outer surface of the insulator 7 was covered with the super hydrophilic membrane 11.

In the spark ignition plug 60, the super hydrophilic membrane 11 was continuously formed from the intermediate section 72 of the insulator to the front end surface having a ring shape of the insulator 7 through the outer surface having a tapered shape at the front end side of the insulator 7. The super hydrophilic membrane 11 formed on the distal end side of the insulator 7 had an outer diameter of 6.4 mmϕ, the super hydrophilic membrane 11 formed on the front end side of the insulator 7 had an outer diameter of 4.2 mmϕ. The super hydrophilic membrane 11 had an axial length of 13.2 mm. The housing 63, which faces the super hydrophilic membrane 11, had an inner diameter of 7.3 mmϕ. The screw part of the housing 63 had a nominal diameter of M12.

A coating solution was prepared so as to produce the super hydrophilic membrane 11. The experiment was uses a solution A which contains silica as a raw material of the super hydrophilic particles 110 and a solution B which contains titania as a raw material of the thermal excitation catalyst particles 111. The solution A was prepared by mixing silica as the main material and a binder, etc.

That is, the experiment used silica sol ("Zero Clear" (Japanese registered trademark) manufactured by GOGO Corporation) which contains the main material having the composition ratio shown in Table 3 and a hardener having the composition ratio shown in Table 2.

Further, the experiment used, as the solution B, titania sol ("TKD-801", Weight average diameter of $TiO_2$ is 78 mm, Concentration of $TiO_2$ is 17 wt %, PH=7, manufactured by TAYCA Corporation).

The experiment mixed the solution A and the solution B so as to contain titania of a weight ratio of 0.4, 7.5, 10, 12.5, 15, 20, 40, 60 and 100 (wt %) on the basis of a weight ratio of silica and titania in the solution A and the solution B.

The prepared solutions having the composition ratios previously described were applied on the surface of each of the insulators 7, and the insulators 7 were burned to produce various types of the super hydrophilic membrane 11. In the method of burning the insulator 7, i.e. the super hydrophilic membrane 11, the central electrode 61 was inserted into the inside of the axial hole 71 of the insulator 7, and fixed. Next, a plasma was irradiated on the outer surface of the insulator 7, on which the super hydrophilic membrane 11 would be formed, so as to remove oil and dust which would reduce the adhesion of the super hydrophilic membrane 11 on the outer surface of the insulator 7. The coating solution was applied on the outer surface of the insulator 7 by using an air spray gun. The insulator 7 was dried over 30 minutes, and maintained in air atmosphere at 500° C. for two hours, and then cooled. This produces the super hydrophilic membrane 11 having a predetermined thickness (for example, 10 μm) on the outer surface of the insulator 7 designated by bold dotted line shown in FIG. 4.

The ground electrode 62 was fixed to the housing 63 by welding, and fitted to the outside of the insulator 7 having the central electrode 61. The distal end edge portion of the housing 63 was tightened and fixed to produce the spark ignition plug 60.

The produced spark ignition plug 60 was fixed through a gasket (not shown) to a mounting hole in the wall of the combustion chamber 51 by using a screw. This provided the airtightness between the spark ignition plug 60 and the combustion chamber 51. The power supply section 8 was connected to the central electrode 61 of the spark ignition plug 60 to produce the spark ignition device 6.

Figure 5:
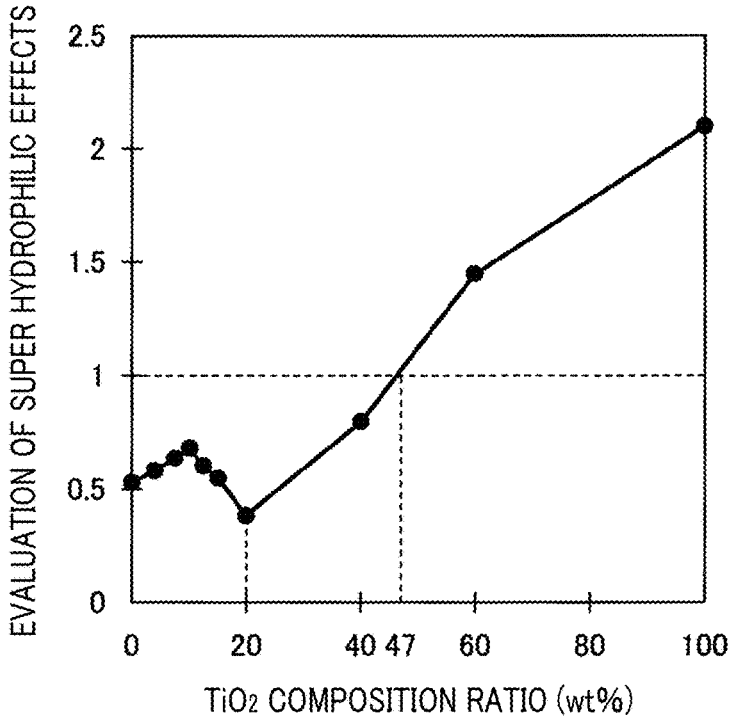
FIG. 5 is a characteristics view showing effects of a titania mixing ratio to the hydrophilicity of the super hydrophilic membrane.

FIG. 5 shows a relationship between the water contact angle and a composition ratio of titania (i.e. within a range of 1 to 100 wt %) to silica, i.e. shows the experimental results when the water contact angle of the super hydrophilic membrane 11 and water was detected after dropping a drop of distilled water on the surface of the super hydrophilic membrane 11.

Similar to the case according to the first exemplary embodiment, previously described, shown in FIG. 3A, the second exemplary embodiment evaluates the super hydrophilic function of the spark ignition plug 60 by using the relative water contact angle $\theta_{W2}/\theta_{W1}$, where $\theta_{W1}$ indicates the water contact angle between the insulator 7 having no super hydrophilic membrane and water, and $\theta_{W2}$ indicates the water contact angle between the insulator 7 having the super hydrophilic membrane 11 and water.

As shown in FIG. 5, the super hydrophilic function of the insulator 7 with the super hydrophilic membrane 11 becomes higher than that of the insulator 7 without the super hydrophilic membrane 11 when the composition ratio of titania to silica was not more than 47 wt %, i.e. when $\theta_{W2}<\theta_{W1}$.

This range makes it possible for the super hydrophilic membrane 11 formed on the surface of the insulator 7 to easily adsorb water generated by combustion in the combustion chamber, and the presence of the adsorbed water makes it possible for the insulator 7 to have the improved oil repellent effects. Further, because the relative water contact angle $\theta_{W2}/\theta_{W1}$ becomes small due to the reduction of the composition ratio of titania to silica. The relative water contact angle $\theta_{W2}/\theta_{W1}$ has the minimum value when the composition ratio of titania to silica is approximately 20%, or not more than 20%.

Figure 6:
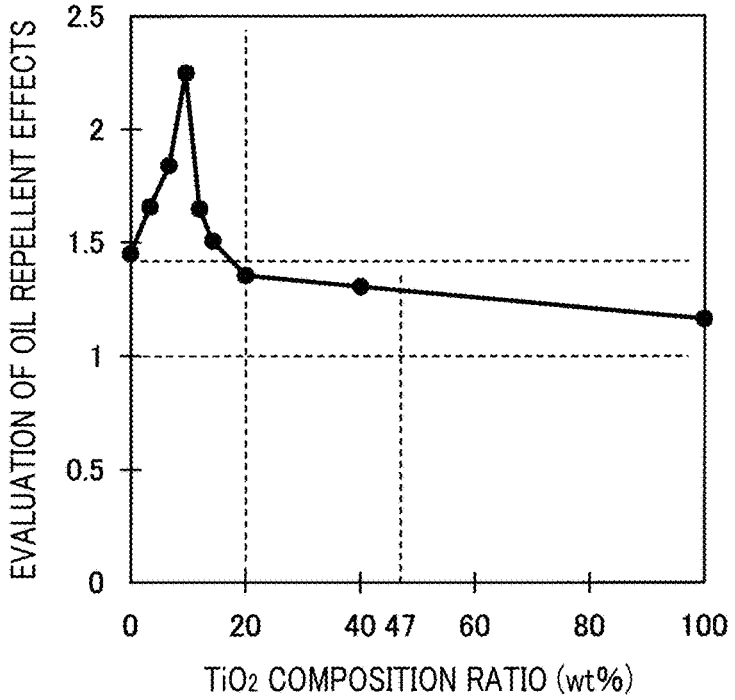
FIG. 6 is a characteristics view showing effects of the titania mixing ratio to the oil repellent of the super hydrophilic membrane.

FIG. 6 shows a relationship between the oil contact angle and a composition ratio of titania (i.e. within a range of 1 to 100 wt %) to silica, i.e. shows the experimental results when the oil contact angle of the super hydrophilic membrane 11 and oil was detected after dropping a drop of engine oil on the surface of the super hydrophilic membrane 11.

Similar to the case according to the first exemplary embodiment, previously described, shown in FIG. 3B, the second exemplary embodiment evaluates the oil repellent effects of the spark ignition plug 60 by using the relative oil contact angle $\theta_{O2}/\theta_{O1}$, where $\theta_{O1}$ indicates the oil contact angle between the insulator 7 having no super hydrophilic membrane and engine oil, and $\theta_{O2}$ indicates the oil contact angle between the insulator 7 having the super hydrophilic membrane 11 and engine oil.

As shown in FIG. 6, the oil repellent effects of the insulator 7 with the super hydrophilic membrane 11 becomes further higher than that of the insulator 7 without the super hydrophilic membrane 11 when the composition ratio of titania to silica was not more than 20 wt %, i.e. when $\theta_{O2}>\theta_{O1}$. This specific characteristics make it possible to reduce a total amount of materials such as engine oil, gasoline, carbon, etc. which are floating in the inside of the combustion chamber 51 and would be adhered on the surface of the insulator.

Figure 7:
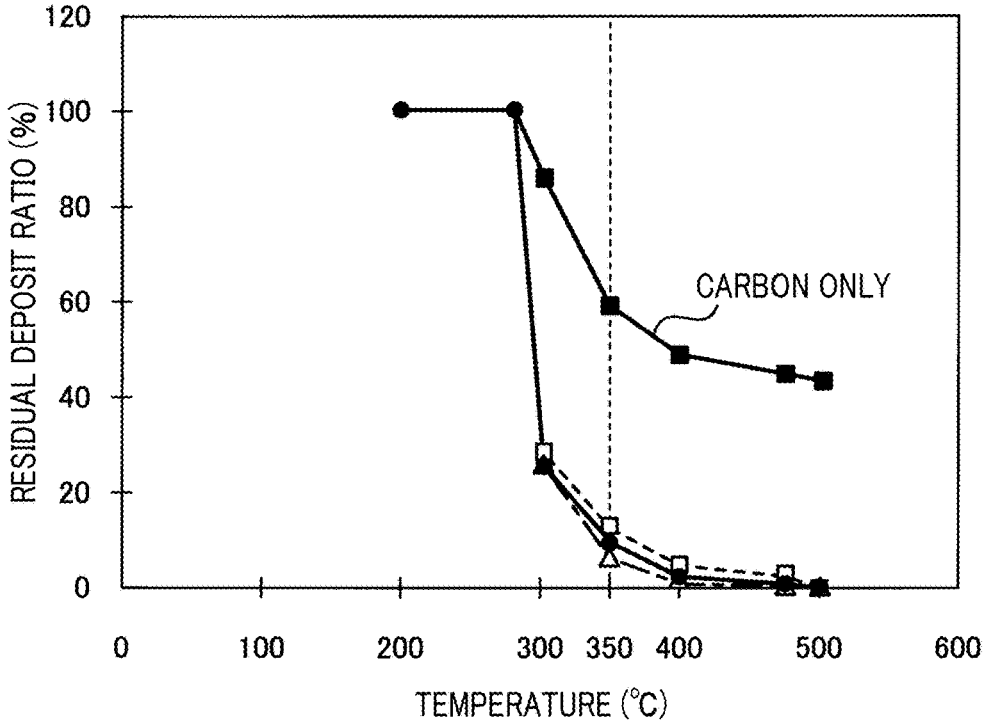
FIG. 7 is a characteristics view showing a relationship between a catalyst performance of the super hydrophilic membrane having a different titania mixing ratio and a temperature.

FIG. 7 shows the experimental results of catalyst characteristics of titania when the composition ratio (i.e. within a range of 4 wt % to 40 wt %) of titania to silica, i.e. shows a residual ratio of carbon deposit on the insulator due to the use conditions of the spark ignition plug. Specifically, the plural super hydrophilic membrane 11 were prepared, which had a different composition range of titania within the range of 4 wt % to 40 wt %. Those super hydrophilic membrane 11 was pulverized in a mortar. The pulverized super hydrophilic membrane 11 and the carbon deposit (which contained engine oil, gasoline, carbon, etc.) obtained from the surface of the spark ignition plug were mixed to produce a test sample. The obtained plural test samples were burned at different temperatures to detect a thermal weight of the test sample, and a residual ratio of the carbon deposit on the test sample was detected. The experiment used a comparative sample in which the deposit contained carbon only.

As shown in FIG. 7, when the plural test samples containing titania within a range of 4 wt % to 40 wt %, the carbon deposit is drastically reduced in amount in accordance with the temperature rise. In particular, at a temperature of not less than 350° C., the residual ratio of the carbon deposit on the test sample becomes less than 10% when compared with the test sample having carbon only as the deposit. Further, at a temperature of not less than 400° C., the residual ratio of the carbon deposit on the test sample is further reduced. As a result, it can be understood that the catalysis of titania contained in the super hydrophilic membrane 11 drastically promotes the oxidative combustion of carbon.

Figure 8:
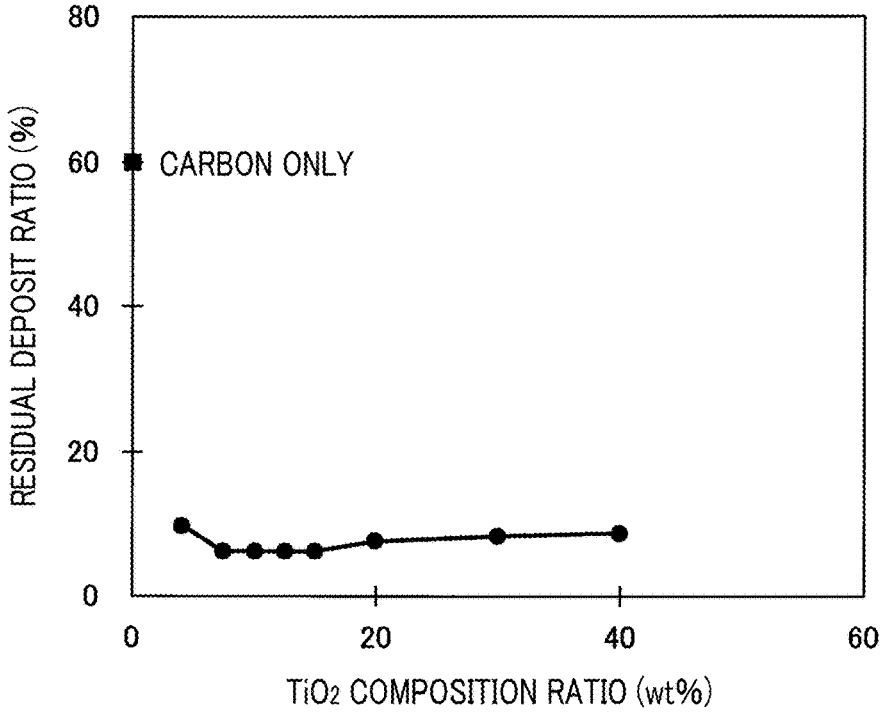
FIG. 8 is a characteristics view showing effects of the titania mixing ratio to a catalytic performance of the super hydrophilic membrane.

FIG. 8 shows detection results of the residual ratio of the carbon deposit on the insulator as the test sample at a temperature of 350° C. when the composition ratio (i.e. within a range of 4 wt % to 40 wt %) of titania to silica was changed.

As shown in FIG. 8, it is clearly understood that the catalysis of titania does not drastically vary when the composition ratio of titania is varied. That is, the presence of titania as the thermal excitation catalyst particles 111 provides its catalyst characteristics to the super hydrophilic membrane 11, and promotes the combustion of carbon particles adhered on the surface of the insulator 7. This makes it possible to prevent the propagation of spark discharge, caused by carbon having a high conductivity adhered on the surface of the insulator 7, toward the innermost side of the spark ignition plug. As a result, the second exemplary embodiment provides the spark ignition plug 60 having anti-smoldering function.

Figure 9:
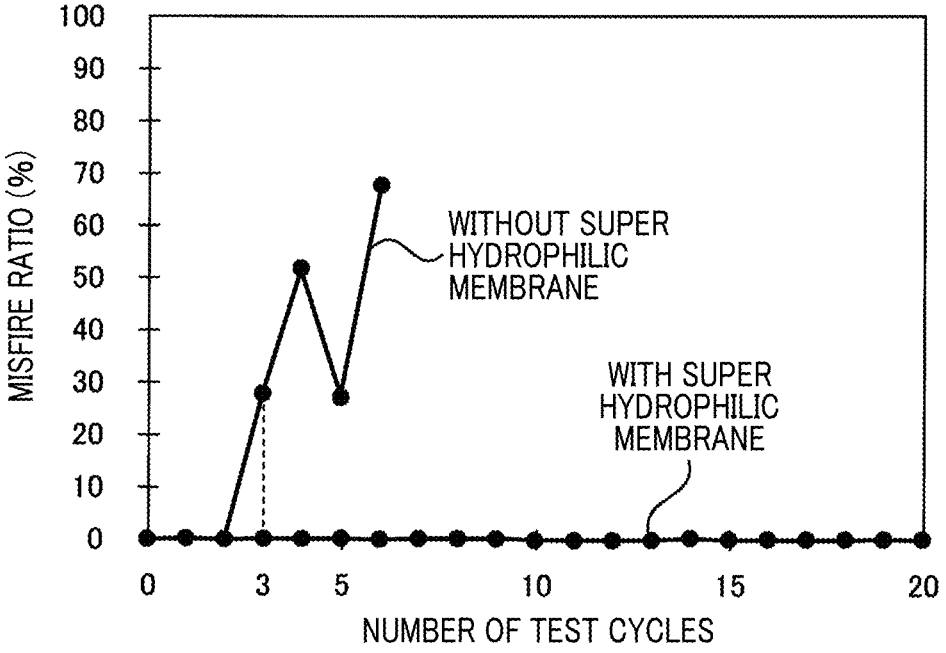
FIG. 9 is a characteristics view showing a relationship between the number of cycles and a misfire rate as a comparison result of comparing a smoldering test of a spark ignition plug with a presence of the super hydrophilic membrane.

FIG. 9 shows the experimental results of smoldering test of the spark ignition device 6 equipped with the spark ignition plug 60 having the structure shown in FIG. 4.

The super hydrophilic membrane 11 was produced so that the composition ratio of titania to silica was 10 wt % and a thickness thereof had 10 μm. The smoldering test of the spark ignition device 6 was performed on the basis of the smoldering test pattern (i.e. JIS D 1606) determined in the Japanese Industrial (JIS) Standard. The test was used a series four-cylinder engine having 080.5 of a bore diameter, 78.5 mm of a stroke, a DOHC, sixteen valves and a port-injection system.

FIG. 9 shows the comparison results of the misfire ratio of the spark ignition plug 60 between the insulator 7 on which the super hydrophilic membrane 11 was formed, and the insulator 7 without the super hydrophilic membrane 11. As can be understood from FIG. 9, the spark ignition plug 60 having the insulator 7 without the super hydrophilic membrane 11 suffered a misfire at the third cycle, and the engine using this spark ignition plug 60 did not start at the seventh cycle. On the other hand, the engine having the spark ignition plug 60 with the super hydrophilic membrane 11 correctly started over twenty cycles, and did not suffer any misfires.

Figure 10:
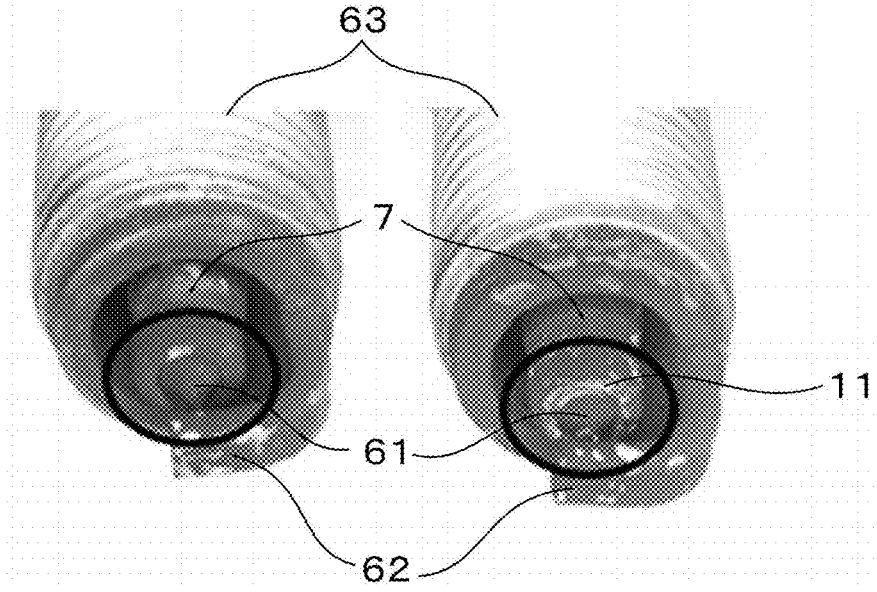
FIG. 10 is a view showing a photograph showing a surface of the super hydrophilic membrane in a spark plug and a surface of a spark plug without any super hydrophilic membrane in the smoldering test.

As shown in FIG. 10, the adhesion state of carbon at the front side of the spark ignition plug 60 having the super hydrophilic membrane 11 was drastically different from that at the front side of the spark ignition plug 60 without the super hydrophilic membrane 11.

That is, as shown at the right side in FIG. 10, the spark ignition plug 60 having the insulator 7 with the super hydrophilic membrane 11 a less amount of carbon particles adhered around the central electrode 61 of the surface of the insulator 7. In this case, the super hydrophilic membrane 11 formed on the surface of the insulator was exposed.

On the other hand, the carbon deposit was detected on the surface of the insulator 7 without the super hydrophilic membrane 11, at the left side in FIG. 10. That is, a conductive path was generated by the carbon accumulated on the surface of the insulator 7 and the misfire occurred due to the carbon deposit.

There is the effect that the spark ignition plug 60 having the insulator 7 with the super hydrophilic membrane 11 has the drastically-improved ignitability because the super hydrophilic membrane 11 cuts the conductive path of the carbon deposit accumulated on the surface of the insulator 7.

Figure 11:
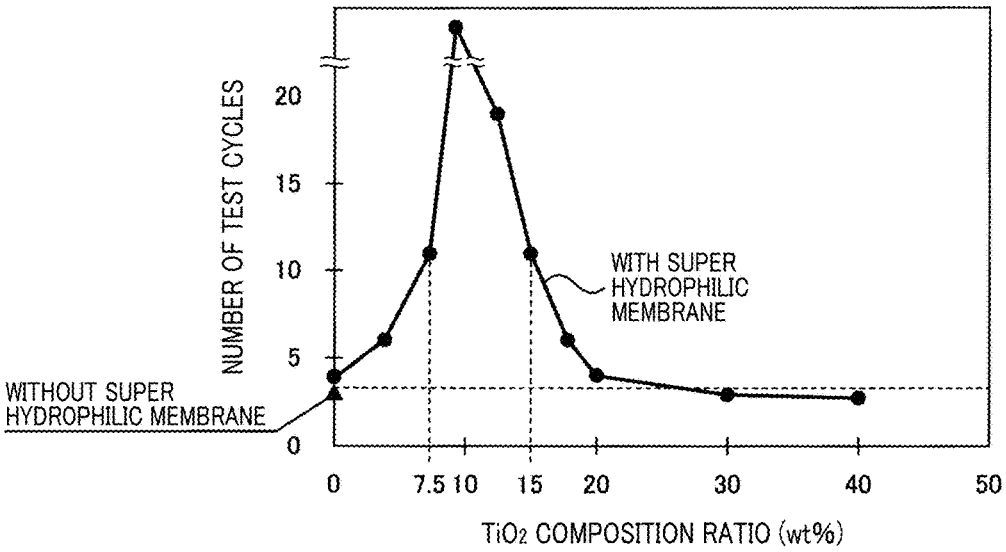
FIG. 11 is a characteristics view showing effects of the titania mixing ratio to the number of cycles until an occurrence of the misfire.

FIG. 11 shows the detection results of the number of test cycles until the misfire occurred when the composition ratio of titania ($SiO_2$) in the super hydrophilic membrane 11 was changed within a range of 0 to 50 wt %. The detection results shown in FIG. 11 indicate that the number of the test cycles until the misfire occurred increases according to the increasing of the composition ratio of titania. When the composition ratio of titania was approximately 10 wt %, the number of the test cycles became the maximum value. When the composition ratio of titania exceeded 10 wt %, the number of the test cycles reduced again.

When the composition ratio of titania exceeded 30 wt %, the number of the test cycles became a constant value which was approximately equal to the case when the insulator 7 of the spark ignition plug 60 did not have the super hydrophilic membrane 11. Accordingly, the experiment results clearly teach that it is preferable to use titania having the composition ratio within a range of 7.5 wt % to 15 wt % in the super hydrophilic membrane 11 to be formed on the surface of the insulator 7 of the spark ignition plug 60. (That is, it is preferable to determine the composition ratio of titania so that the number of the cycles until the misfire occurs is not less than 10 cycles.)

Figure 12:
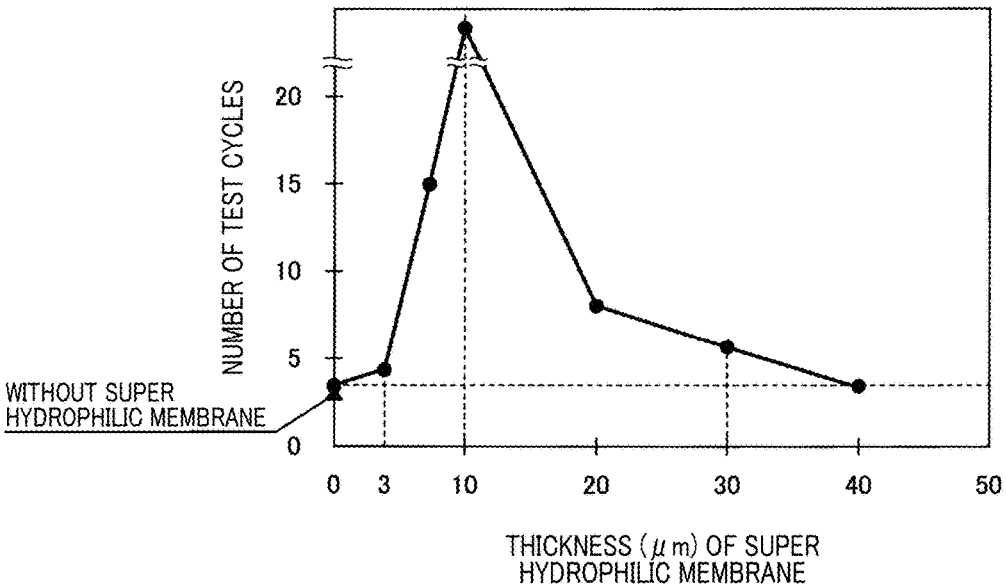
FIG. 12 is a characteristics view showing effects of the presence of the super hydrophilic membrane to the number of cycles until the occurrence of the misfire.

FIG. 12 shows the detection results of the number of test cycles until the misfire occurred when the composition ratio of titania ($SiO_2$) in the super hydrophilic membrane 11 was 10 wt % and a thickness of the super hydrophilic membrane 11 was changed within a range of 0 to 50 μm. The detection results shown in FIG. 12 indicate that the number of the test cycles until the misfire occurred increases according to the increasing of the thickness of the super hydrophilic membrane 11.

When the thickness of the super hydrophilic membrane 11 was approximately 10 μm, the number of the test cycles became the maximum value. When the thickness of the super hydrophilic membrane 11 exceeded 10 μm, the number of the test cycles reduced again.

When the thickness of the super hydrophilic membrane 11 became approximately 40 μm, the number of the test cycles became a constant value which was approximately equal to the case when the insulator 7 of the spark ignition plug 60 did not have the super hydrophilic membrane 11.

Accordingly, the experiment results clearly teach that it is preferable to use the super hydrophilic membrane 11 having the thickness within a range of 3 μm to 30 μmin which is formed on the surface of the insulator 7 of the spark ignition plug 60.

Third Exemplary Embodiment

A description will be given of the spark ignition plug 60 to be used by the spark ignition device 6 according to the third exemplary embodiment with reference to FIG. 13.

Figure 13:
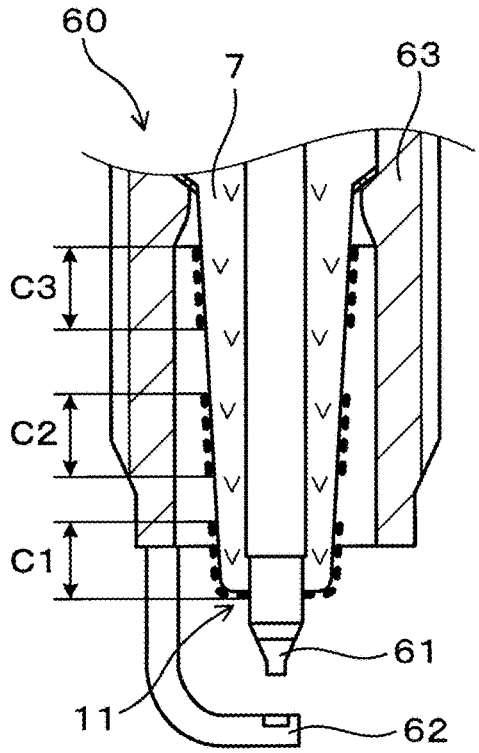
FIG. 13 is a vertical cross sectional view showing a part of a spark ignition device according to a third exemplary embodiment of the present invention.

As shown in FIG. 13, it is possible to change a coating pattern and area of the super hydrophilic membrane 11 which is formed on the surface of the insulator 7 in the spark ignition plug 60 in the spark ignition device 6 according to the third exemplary embodiment.

As shown in FIG. 3, in the spark ignition plug 60 according to the third exemplary embodiment, the super hydrophilic membrane 11 is formed on three formation areas, i.e. on an area C1 at the front side, an area C2 at the intermediate side, and an area C3 at the distal end side of the insulator 7, which are formed at a predetermined interval. It is also possible to change the length of each of the area C1, the area C2 and the area C3 to a different length along the axial direction of the insulator 7. It is also possible to form the area C1, the area C2 and the area C3 at a different interval on the surface of the insulator 7.

The method of forming the super hydrophilic membrane 11, the structure of the spark ignition device 6 are the same as those of the first exemplary embodiments. The explanation of the same components and method is omitted here for brevity.

It is not necessary to form the overall outer surface of the insulator 7. As previously described, when the super hydrophilic membrane 11 is formed on different areas at the front side and the distal end side of the insulator 7, it is possible to reduce the manufacturing cost of the super hydrophilic membrane 11.

It is preferable to form the super hydrophilic membrane 11 on at least the front end side of the insulator 7 when the super hydrophilic membrane 11 is formed on a part of the surface of the insulator 7.

When the combustion chamber of the internal combustion engine works at a low temperature, for example, when the internal combustion engine starts, it is possible for a temperature of the front end side of the insulator 7 in the spark ignition plug 60 to quickly increase. Because the thermal excitation catalyst particles 111 such as titania contained in the area C1 of the super hydrophilic membrane 11 formed at the front end side on the surface of the insulator 7 quickly and easily reach the catalyst activation temperature thereof, it is possible to easily burn carbon particles adhered on the area C1 at the front end side of the insulator 7. On the other hand, because the area C2 at the intermediate side and the area C3 at the distal end side of the insulator 7 have a temperature which is lower than the temperature at the front end side of the insulator 7, carbon particles adhered on the area C2 and the area C3 are not burned and remain at a low temperature condition of the spark ignition plug 60 when the internal combustion engine starts. The remained carbon particles adhered on the area C2 and the area C3 will be burned, decomposed, and eliminated from the surface of the insulator 7 when the temperature of the spark ignition plug 60 adequately increases and reaches the catalyst activation temperature thereof according to increasing of the load of the internal combustion engine.

Fourth Exemplary Embodiment

A description will be given of the spark ignition plug 60 to be used by the spark ignition device 6 according to the fourth exemplary embodiment with reference to FIG. 14.

Figure 14:
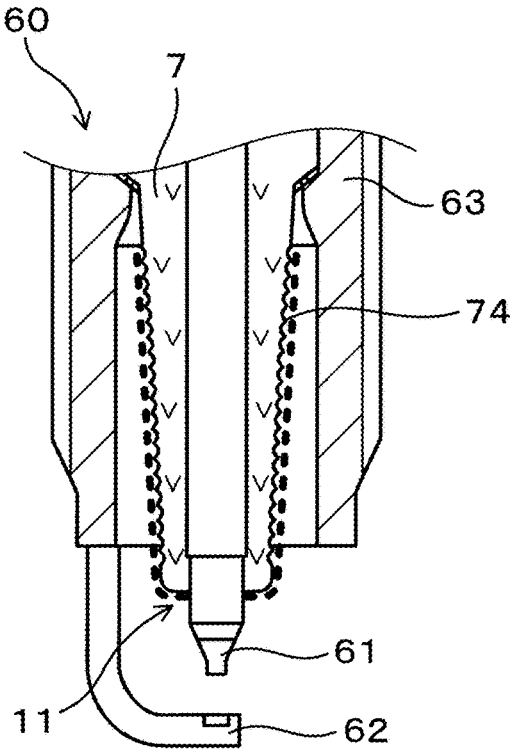
FIG. 14 is a vertical cross sectional view showing a part of a spark ignition device according to a fourth exemplary embodiment of the present invention.

As shown in FIG. 14, it is possible for the insulator 7 in the spark ignition plug 60 to have an uneven surface structure. For example, the spark ignition plug 60 of the spark ignition device 6 according to the fourth exemplary embodiment has the insulator 7 in which almost the overall outer surface, which faces the inner surface of the mounting attachment which is arranged in the housing 63, has an uneven surface area 74.

The super hydrophilic membrane 11 is coated and formed on the outer surface of the insulator 7, which includes the front end side of the insulator 7. This structure makes it possible to increase the contact surface area of the thermal excitation catalyst particles 111 such as titania contained in the super hydrophilic membrane 11 with carbon, and to promote the oxidation combustion of the carbon particles adhered on the surface of the insulator 7.

Furthermore, because the formation of the super hydrophilic membrane 11 on the surface of the insulator 7 generates cracks in the carbon particles adhered on the surface of the insulator 7, this structure makes it possible to prevent the insulation resistant of the insulator 7 from being reduced. Furthermore, this structure of the insulator 7 makes it possible to increase the adhesion of the super hydrophilic membrane 11 on the surface of the insulator 7 by the anchor effect. It is also acceptable to optionally adjust the formation range and the shape of the uneven area 74 according to request.

Fifth Exemplary Embodiment

Figure 15:
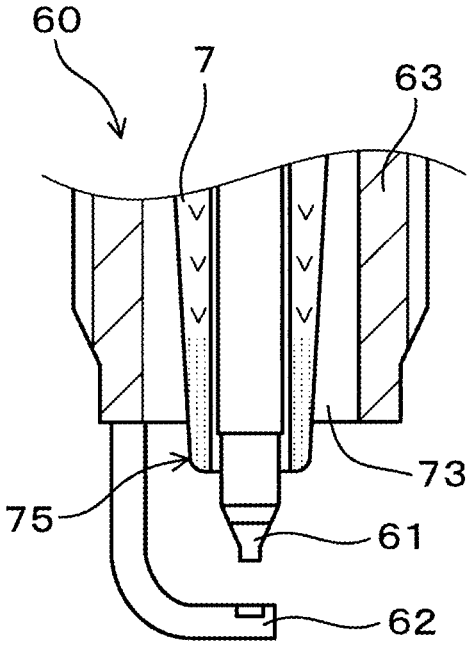
FIG. 15 is a vertical cross sectional view showing a part of a spark ignition device according to a fifth exemplary embodiment of the present invention.

A description will be given of the spark ignition plug to be used by the spark ignition device according to the fifth exemplary embodiment with reference to FIG. 15.

The first to fourth exemplary embodiments previously described show the various structures in which the super hydrophilic membrane 11 is formed on the outer surface at the front end side of the insulator 7. It is also possible to form the super hydrophilic membrane 11 on both the outer surface and the inner surface at the front end side of the insulator 7. This structure of the super hydrophilic membrane 11 makes it possible to further burn carbon accumulated between the central electrode 61 and the insulator 7.

It is also acceptable to use various other methods of forming the super hydrophilic membrane 11 in addition to the method of applying a coating solution on the insulator previously described.

For example, it is possible to use the thermal excitation catalyst particles 111 such as titania, etc. having the composition ratio previously described (for example, 10 wt %) to composition ratio of silica when insulation ceramic material forming the insulator 7 contains silica. In this structure, similar to the spark ignition plug 60 to be applied to the spark ignition device 6 according to the fifth exemplary embodiment, the insulation ceramic material containing the thermal excitation catalyst particles 111 such as titania is applied on the surface at the front end side of the insulator 7. This produces the super hydrophilic membrane 11 on the surface of the insulator. In this case, it is sufficient to prepare insulation ceramic material having a predetermined composition ratio in advance, and to burn it by the usual burning process. This eliminates the formation step of forming the super hydrophilic membrane 11. Furthermore, because the super hydrophilic membrane 11 is formed also on the inner surface of the insulator 7, it is possible to easily oxidize and burn carbon accumulated between the central electrode 61 and the insulator 7.

Sixth Exemplary Embodiment

A description will be given of the spark ignition plug to be used by the spark ignition device according to the sixth exemplary embodiment with reference to FIG. 16. That is, it is possible to use the structure of the spark ignition plug 60 shown in FIG. 16 instead of using the basic structure of the spark ignition plug 60 according to the second exemplary embodiment previously described.

Because the sixth exemplary embodiment uses the structure of the super hydrophilic membrane 11, the method of forming the super hydrophilic membrane 11, the formation area on the insulator 7, and other structure of the spark ignition device 6 which are the same as those in the exemplary embodiments previously described, the explanation of the same components and methods is omitted here for brevity.

Figure 16:
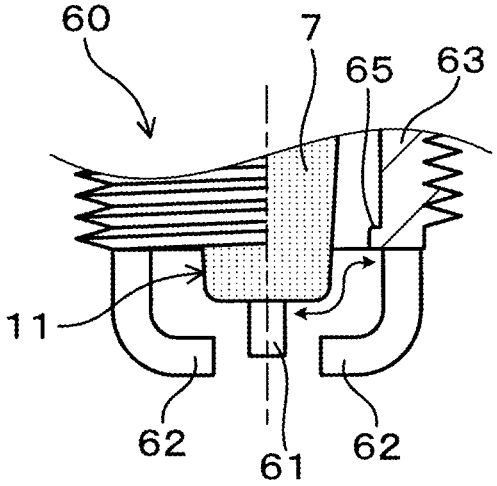
FIG. 16 is a vertical cross sectional view showing a part of a spark ignition device according to a sixth exemplary embodiment of the present invention.

As shown in FIG. 16, the spark ignition device 6 according to the sixth exemplary embodiment has a double-electrode type structure in which two ground electrodes 62 are arranged at both the sides of the central electrode 61 so that the front end sides of the two ground electrode 62 face the front end side surfaces of the central electrode 61.

Further, the inner peripheral edge portion at the front end side of the housing 63 projects inward to form a supplementary ground electrode 65.

The spark ignition plug 60 of the double electrode type having the structure previously described has the function of burning carbon particles adhered and accumulated on the insulator 7 by sparks flying to the supplementary ground electrode 65. In addition to this structure, the super hydrophilic membrane 11 is formed on the surface of the insulator 7. This improved structure makes it possible to promote the catalysis of titania $TiO_2$, and to improve the function of burning and decompose carbon accumulated on the insulator 7, and eliminate it from the insulator 7.

Seventh Exemplary Embodiment

Figure 17:
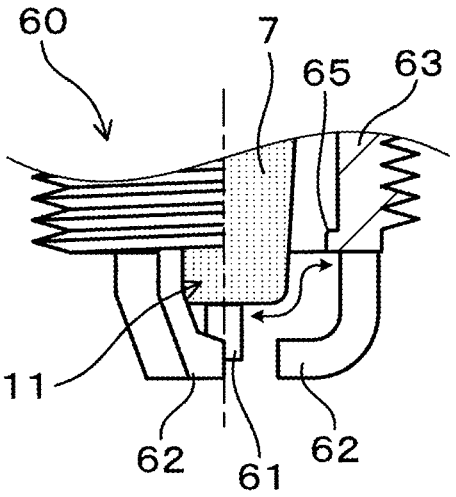
FIG. 17 is a vertical cross sectional view showing a part of a spark ignition device according to a seventh exemplary embodiment of the present invention.

A description will be given of the spark ignition plug to be used by the spark ignition device according to the seventh exemplary embodiment with reference to FIG. 17.

It is possible for the spark ignition device according to the present invention to use a spark ignition plug of a multiple electrode type instead of using the spark ignition plug of a double electrode structure type. In the structure of the spark ignition plug 60 according to the seventh exemplary embodiment shown in FIG. 17, supplementary ground electrodes 65 are arranged at three locations on the front end surface of the mounting attachment of the housing 63, and the front end portion of the supplementary ground electrodes 65 are arranged facing the front end side surface portion of the central electrode 61. Further, the super hydrophilic membrane 11 is formed on the surface of the insulator 7. This improved structure makes it possible to provide the same as the effects of the spark ignition device according to each of the exemplary embodiments previously described.

Eighth Exemplary Embodiment

A description will be given of the spark ignition plug 60 to be used by the spark ignition device 6 according to the eighth exemplary embodiment with reference to FIG. 18.

Figure 18:
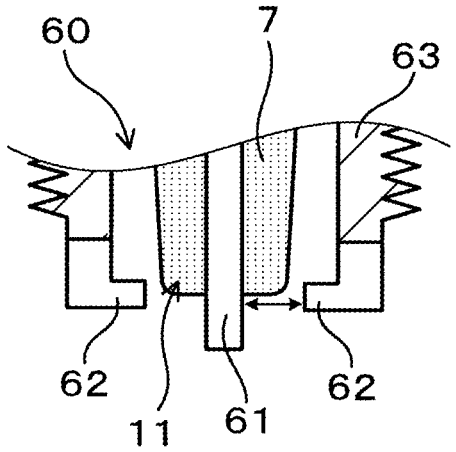
FIG. 18 is a vertical cross sectional view showing a part of a spark ignition device according to an eighth exemplary embodiment of the present invention.

As shown in FIG. 18, in the structure of the spark ignition plug 60 spark ignition plug 60 of a double electrode structure type, the front end portion of each of the ground electrodes 62 of a double electrode structure type, which face with each other, is arranged along a front surface the insulator 7 and to close the front end surface of the insulator 7. When the super hydrophilic membrane 11 is formed on the surface of the insulator 7, it is possible for the spark ignition plug 60 having this structure to have the effects which are the same as the effects of the spark ignition plug 60 in the spark ignition device according to the exemplary embodiments previously described.

As previously described in detail, it is possible for the super hydrophilic membrane 11 having the super hydrophilic function, the oil repellent effects and catalysis to reduce an amount of deposit adhered and accumulated on the surface of the insulator 7, and to improve ignitability of the spark ignition plug 60 and to increase the durability of the spark ignition plug 60.

The concept of the spark ignition device 6 according to the present invention is not limited by the structures according to each of the exemplary embodiments previously described. It is possible for the spark ignition device 6 to have various structures within the concept of the present invention. In addition, it is possible to use other components, for example, another terminal attachment, conductive sealing layer, resistant element, insulator and mounting attachment, which have a different shape and are made of different material so as to form the spark ignition plug 60. The exemplary embodiments show the spark ignition device 6 applied to the internal combustion engines for motor vehicles. However, the concept of the present invention is not limited by this. It is possible to apply the spark ignition device 6 according to the present invention to spark plugs P to be used for cogeneration devices and apparatus, gas pressure pumps, etc.

REFERENCE SIGNS LIST

1 Laser ignition device (ignition device), 3 Housing, 4 Laser ignition plug (ignition plug), 5 Internal combustion engine, 10 Optical window (plug forming member), 11 Super hydrophilic membrane, 12 Optical element, 13 excitation light source, 20 Buffer member, 21 Sealing member, 22 Optical window holder, 23 Condenser lens holder, 30 Wrapping and tightening part, 31 Thermally tightening section, 32 Cylindrical shaped section, 33 Screw section, 50 Engine head (wall of combustion chamber), 51 Combustion chamber, 52 Piston, 110 Super hydrophilic particles, 111 Thermal excitation catalyst particles, 120 Condenser lens, 121 Expansion lens, 122 Laser resonator, 123 Collimator lens, FP Focus point, $LSR_{PMP}$ Excitation laser, and $LSR_{PLS}$ Pulse laser.

The invention claimed is:

1. An ignition device comprising an ignition plug mounted to a combustion chamber of an internal combustion engine, the ignition device igniting a fuel gas mixture introduced into an inside of the combustion chamber, wherein the ignition plug comprises a plug forming member, and a super hydrophilic membrane formed on a surface at the combustion chamber side of the plug forming member, the super hydrophilic membrane contains super hydrophilic particles and thermal excitation catalyst particles, the super hydrophilic membrane satisfies a relationship of $\theta_{W2}<\theta_{W1}$, where $\theta_{W1}$ indicates a water contact angle between the plug forming member and water when no super hydrophilic membrane is formed on the surface of the plug forming member, and $\theta_{W2}$ indicates a water contact angle between the plug forming member and water when the super hydrophilic membrane is formed on the surface of the plug forming member.

2. The ignition device according to claim 1, wherein the super hydrophilic membrane satisfies a relationship of $\theta_{O2}>\theta_{O1}$, where $\theta_{O1}$ indicates an oil contact angle between the plug forming member having no super hydrophilic membrane and oil, and $\theta_{O2}$ indicates an oil contact angle between the plug forming member having the super hydrophilic membrane and oil.

3. The ignition device according to claim 1, wherein the super hydrophilic membrane has a composition ratio of not more than 47% of the thermal excitation catalyst particles in a total sum of the super hydrophilic particles and the thermal excitation catalyst particles.

4. The ignition device according to claim 1, wherein the super hydrophilic membrane has a composition ratio of not more than 20% of the thermal excitation catalyst particles in a total sum of the super hydrophilic particles and the thermal excitation catalyst particles.

5. The ignition device according to claim 1, wherein the super hydrophilic membrane contains a binder component as a forming material of the super hydrophilic membrane.

6. The ignition device according to claim 5, wherein the binder component is at least one kind selected from a phosphate and a metal oxide.

7. The ignition device according to claim 1, wherein the super hydrophilic particles in the super hydrophilic membrane contain silica ($SiO_2$), and the thermal excitation catalyst particles in the super hydrophilic membrane contain at least one or more kinds selected from transition metal oxide and tin oxide ($SnO_2$).

8. The ignition device according to claim 7, wherein the transition metal oxide contains at least one or more kinds selected from $TiO_2$, $ZrO_2$, $Cr_2O_3$, $Y_2O_3$, ZnO, $CeO_2$, $Ta_2O_5$, $CuO_2$, CuO and $WO_3$.

9. The ignition device according to claim 1, wherein the plug forming member is an optical window arranged at a boundary between the ignition plug and the combustion chamber of the internal combustion engine, and the ignition plug focuses a pulse laser ($LSR_{PLS}$) having a high energy density at a focus point (FR) in the inside of the combustion chamber through the optical window, and ignites a fuel gas mixture introduced into the inside of the combustion chamber, and wherein the super hydrophilic membrane is formed on a surface at the combustion chamber side of the optical window.

10. The ignition device according to claim 9, wherein the super hydrophilic membrane has a relative water contact angle $\theta_{W2}/\theta_{W1}$ of not more than ⅔, where $\theta_{W1}$ indicates the water contact angle between the optical window having no super hydrophilic membrane and water, and $\theta_{W2}$ indicates the water contact angle between the optical window having the super hydrophilic membrane and water.

11. The ignition device according to claim 9, wherein the super hydrophilic membrane has a relative oil contact angle $\theta_{O2}/\theta_{O1}$ of not less than 1.5, where $\theta_{O1}$ indicates the oil contact angle between the optical window having no super hydrophilic membrane and oil, and $\theta_{o2}$ indicates the oil contact angle between the optical window having the super hydrophilic membrane and oil.

12. The ignition device according to claim 9, wherein the super hydrophilic membrane contains silica as the super hydrophilic particles and titania as the thermal excitation catalyst particles, and titania has a content within a range of 3 wt % to 13 wt % to a total sum of silica and titania.

13. The ignition device according to claim 1, wherein the ignition device is a spark ignition device comprising a spark ignition plug, the spark ignition plug comprises:

a central electrode which is arranged to project toward the inside of the combustion chamber of the internal combustion engine;

a ground electrode; and an insulator which supports the outer periphery of the central electrode, wherein the spark ignition plug generates a spark discharge at a gap G formed between the central electrode and the ground electrode so as to ignite a fuel mixture gas introduced into the inside of the combustion chamber, and the super hydrophilic membrane is formed on a surface of the insulator which faces the combustion chamber side.

14. The ignition device according to claim 13, wherein the super hydrophilic membrane contains silica as the super hydrophilic particles and titania as the thermal excitation catalyst particles, and titania has a content of not more than 20 wt % to a total sum of silica and titania.

15. The ignition device according to claim 13, wherein the super hydrophilic membrane contains silica as the super hydrophilic particles and titania as the thermal excitation catalyst particles, and titania has a content within a range of 7.5 wt % to 15 wt % to the total sum of silica and titania.

16. The ignition device according to claim 13, wherein the super hydrophilic membrane has a thickness within a range of 3 μm to 30 μm.

17. A method of producing the super hydrophilic membrane to be used in the ignition device according to claim 1, the method comprising steps of:

mixing a main material which contains silica having a particle size of not more than 450 nm within a range of 90 wt % to 95 wt % with a binder which contains potassium oxide within a range of 80 wt % to 85 wt % as a main component to produce a first mixture;

mixing the first mixture with titania having a particle size of not more than 450 nm having a weight ratio of 1:1 so that the titania has a composition ratio of not more than 47 wt % to a total sum of the titania and the silica contained in the first mixture to produce a second mixture;

dispersing the second mixture in water to produce a slurry;

dropping a drop of the slurry on the surface of the plug forming member, and rotating the plug forming member to produce a thin film of the slurry on the surface of the plug forming member;

drying the plug forming member; and burning the plug forming member at a predetermined temperature.

* * * * *